US007050028B2

(12) United States Patent
Morita

(10) Patent No.: US 7,050,028 B2
(45) Date of Patent: May 23, 2006

(54) REFERENCE VOLTAGE GENERATION CIRCUIT, DISPLAY DRIVE CIRCUIT, DISPLAY DEVICE AND REFERENCE VOLTAGE GENERATION METHOD

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 456 days.

(21) Appl. No.: 10/348,944

(22) Filed: Jan. 23, 2003

(65) Prior Publication Data

US 2003/0151616 A1 Aug. 14, 2003

(30) Foreign Application Priority Data

Feb. 8, 2002 (JP) ..... 2002-032679

(51) Int. Cl.
*G09G 3/36* (2006.01)

(52) U.S. Cl. ..... 345/90; 345/89; 345/690

(58) Field of Classification Search ..... 345/76–77, 345/87–100, 104, 204, 205, 213, 690, 214; 341/154–155

See application file for complete search history.

(56) References Cited

U.S. PATENT DOCUMENTS

| | | | | |
|---|---|---|---|---|
| 5,617,091 | A | 4/1997 | Uda | |
| 5,625,387 | A | 4/1997 | Moon | |
| 5,648,791 | A | 7/1997 | Date et al. | |
| 5,745,092 | A * | 4/1998 | Ito | 345/95 |
| 5,796,379 | A | 8/1998 | Enomoto et al. | |
| 5,894,281 | A | 4/1999 | Toda | |
| 5,943,000 | A * | 8/1999 | Nessi et al. | 341/154 |
| 6,225,992 | B1 * | 5/2001 | Hsu et al. | 345/211 |
| 6,246,385 | B1 | 6/2001 | Kinoshita et al. | |
| 6,256,025 | B1 | 7/2001 | Imai et al. | |
| 6,459,399 | B1 * | 10/2002 | Nozaki | 341/155 |
| 6,727,874 | B1 * | 4/2004 | Okuzono | 345/89 |
| 2003/0151577 | A1 * | 8/2003 | Morita | 345/89 |

FOREIGN PATENT DOCUMENTS

| | | |
|---|---|---|
| DE | 199 47 115 A1 | 6/2001 |
| EP | 0 414 593 A2 | 2/1991 |
| EP | 0 852 372 A1 | 7/1998 |
| EP | 1 054 512 A2 | 11/2000 |
| JP | 03-105313 | 5/1991 |

(Continued)

OTHER PUBLICATIONS

U.S. Appl. No. 10/354,999, filed Jan. 31, 2003, Morita.

(Continued)

*Primary Examiner*—Ricardo Osorio
*Assistant Examiner*—Mansour M. Said
(74) *Attorney, Agent, or Firm*—Oliff & Berridge, PLC

(57) ABSTRACT

A reference voltage generation circuit includes a ladder resistor circuit. First to i-th ("i" is an integer larger than or equal to 2) reference voltages are outputted from first to i-th division nodes which are formed by dividing the ladder resistor circuit by resistor elements $R_0$ to $R_i$ connected in series. A first switching circuit is inserted between one end of the resistor element $R_0$ and a first power source line. A second switching circuit is inserted between one end of the resistor element $R_i$ and a second power sourceline. First to i-th reference voltage output switching circuits are inserted between the first to i-th division nodes and first to i-th reference voltage output nodes. The first and second switching circuits and on/off state of the first to i-th reference voltage output switching circuits are controlled by a given switching control signal.

16 Claims, 17 Drawing Sheets

FOREIGN PATENT DOCUMENTS

| | | |
|---|---|---|
| JP | A 8-254684 | 10/1996 |
| JP | 09-054309 | 2/1997 |
| JP | A 11-202299 | 7/1999 |
| JP | 2000-250494 | 9/2000 |
| JP | A 2001-186040 | 7/2001 |
| JP | A 2001-282188 | 10/2001 |
| KR | A 1998-081805 | 11/1998 |
| TW | 382686 | 2/2000 |

OTHER PUBLICATIONS

U.S. Appl. No. 10/355,298, filed Jan. 31, 2003, Morita.
U.S. Appl. No. 10/349,091, filed Jan. 23, 2003, Morita.

* cited by examiner

| | | SWA | SWB | SWC | SWD |
|---|---|---|---|---|---|
| NORMAL DRIVE | OPERATIONAL AMPLIFIER DRIVE | OFF | OFF | OFF | ON |
| | RESISTOR OUTPUT DRIVE | OFF | OFF | ON | OFF |
| PARTIAL DRIVE | 8-COLOR DRIVE | ON | OFF | OFF | OFF |
| | POL DRIVE | OFF | ON | OFF | OFF |

NORMAL DRIVE MODE (SWA, SWB OFF)

REFERENCE VOLTAGE GENERATION CIRCUIT, DISPLAY DRIVE CIRCUIT, DISPLAY DEVICE AND REFERENCE VOLTAGE GENERATION METHOD

Japanese patent application no. 2002-32679 filed on Feb. 8, 2002, is hereby incorporated by reference in its entirety.

BACKGROUND

The present invention relates to a reference voltage generation circuit, a display drive circuit, a display device and a reference voltage generation method.

Small-sized formation and highly fine formation are required in a display device represented by an electro-optical device of a liquid crystal device and the like. Among them, a liquid crystal device realizes low power consumption and is frequently mounted on a portable electronic device. For example, when a liquid crystal device is mounted as a display portion of a portable telephone, there is requested display of image rich in color tone by many gray scale levels formation.

SUMMARY

An aspect of the invention relates to a reference voltage generation circuit which generates multi-valued reference voltages for generating a gray scale value corrected by gamma correction based on gray scale data, the reference voltage generation circuit comprising:

a ladder resistor circuit including a plurality of resistor circuits connected in series, and outputting voltages of first to i-th division nodes ("i" is an integer larger than or equal to 2) as first to i-th reference voltages, the first to i-th division nodes being formed by dividing the ladder resistor circuit by the resistor circuits;

a first switching circuit inserted between a first power source line supplied with a first power source voltage and one end of the ladder resistor circuit; and a second switching circuit inserted between a second power source line supplied with a second power source voltage and the other end of the ladder resistor circuit, wherein on/off state of the first and second switching circuits are controlled based on first and second switching control signals.

Another aspect of the invention relates to a reference voltage generation method for generating multi-valued reference voltages for generating a gray scale value corrected by gamma correction based on gray scale data, the method comprising:

electrically connecting two opposed ends of a ladder resistor circuit with first and second power source lines, respectively, the ladder resistor circuit outputting voltages of first to i-th division nodes ("i" is an integer larger than or equal to 2) as first to i-th reference voltages, the first to i-th division nodes being formed by dividing the ladder resistor circuit by a plurality of resistor circuits connected in series, the first and second power source lines being supplied with first and second power source voltages, respectively, during a given driving period based on the first to i-th reference voltages, and electrically disconnecting the two ends of the ladder resistor circuit from the first and second power source lines, during a period other than the driving period.

DETAILED DESCRIPTION

Figure 1:
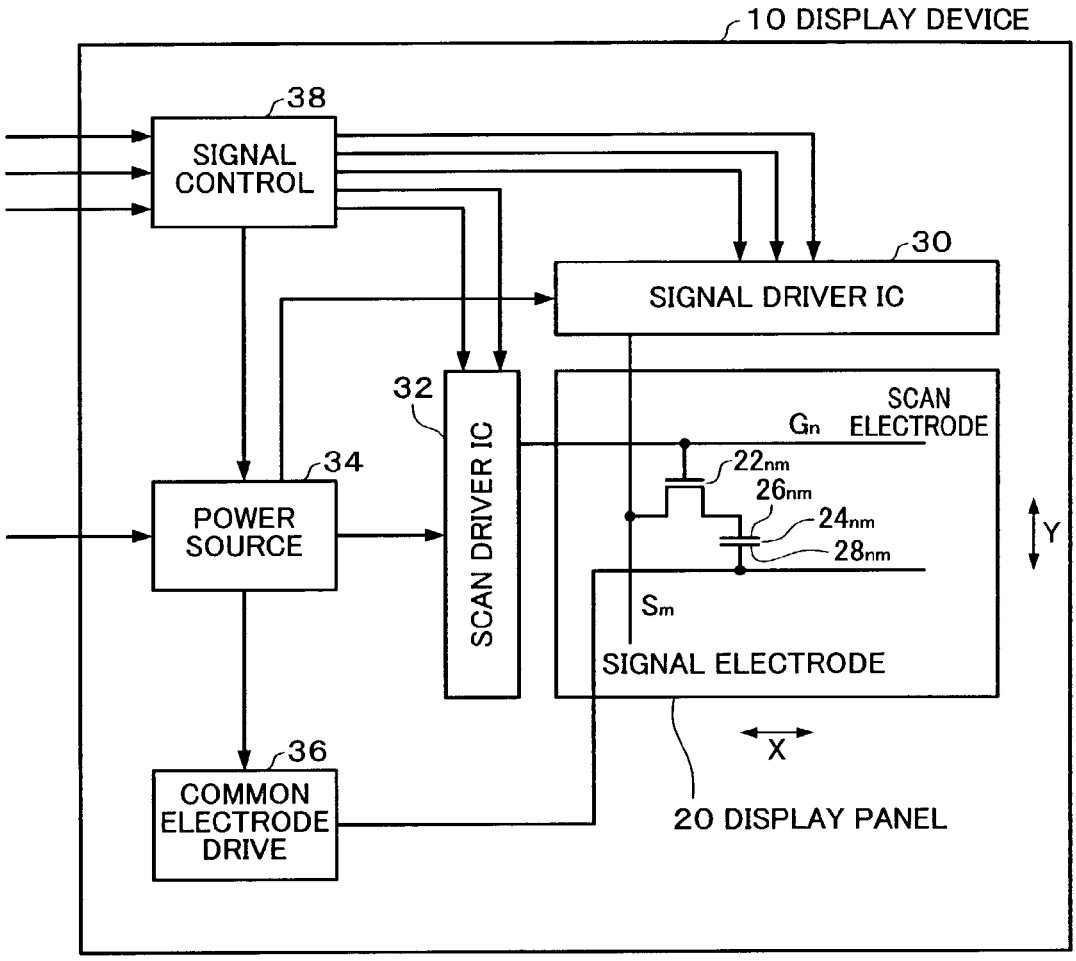
FIG. 1 is a constitutional diagram schematically showing a constitution of a display device to which a display drive circuit including a reference voltage generation circuit is applied.

Embodiments of the present invention will be described as follows. Note that the embodiments described hereunder do not in any way limit the scope of the invention defined by the claims laid out herein. Note also that all of the elements to be described below should not be taken as essential requirements to the means of the present invention.

Generally, an image signal for displaying an image is subjected to gamma correction in accordance with a display characteristic of a display device. The gamma correction is carried out by a gamma correction circuit (in a broad sense, reference voltage generation circuit). When an example is taken by a liquid crystal device, a gamma correction circuit generates voltage in accordance with a transmittance of a pixel based on gray scale data for displaying gray scale.

Such a gamma correction circuit can be constituted by a ladder resistor. In this case, voltages across both ends of respective resistor circuits constituting the ladder resistor are outputted as multi-valued reference voltages in correspondence with gray scale values.

However, current flows to the ladder resistor continually and, this causes a problem that an increase in power consumption is brought about.

The following embodiments can provide a reference voltage generation circuit, a display drive circuit, a display device and a reference voltage generation method capable of achieving low power consumption by controlling current flowing to a ladder resistor for generating reference voltage necessary for gray scale display.

An embodiment of the invention relates to a reference voltage generation circuit which generates multi-valued reference voltages for generating a gray scale value corrected by gamma correction based on gray scale data, the reference voltage generation circuit comprising:

a ladder resistor circuit including a plurality of resistor circuits connected in series, and outputting voltages of first to i-th division nodes ("i" is an integer larger than or equal to 2) as first to i-th reference voltages, the first to i-th division nodes being formed by dividing the ladder resistor circuit by the resistor circuits;

a first switching circuit inserted between a first power source line supplied with a first power source voltage and one end of the ladder resistor circuit; and a second switching circuit inserted between a second power source line supplied with a second power source voltage and the other end of the ladder resistor circuit, wherein on/off state of the first and second switching circuits are controlled based on first and second switching control signals.

In this case, the resistor circuit can be constituted by, for example, a single or a plurality of resistor elements. When the resistor circuit is constituted by a plurality of resistor elements, the resistor elements may be connected in series or in parallel. Further, the configuration may be such that a resistance value of the resistor circuit can variably be controlled by providing switching elements connected to the respective resistor elements in series or in parallel.

Further, when the respective switching circuits are switched on, this means that two opposed ends of the switching circuit are electrically connected. When the respective switching circuits are switched off, the two ends of the switching circuit are electrically disconnected.

In this embodiment, voltages of the division nodes subjected to resistor division by the respective resistor circuits constituting a plurality of ladder resistor circuits are outputted as multi-valued reference voltages. The ladder resistor circuit is connected between the first and second power source lines and voltages produced by subjecting a difference between the first and second power source voltages supplied to the first and second power source lines to resistor division are outputted from the respective division nodes. The voltages outputted from the division nodes are outputted as multi-valued reference voltages and alternatively selected in accordance with, for example, gray scale data and outputted to corresponding signal electrodes as drive voltages corrected by gamma correction. The ladder resistor circuit is applied with the difference between the first and second power source voltages in this way and therefore, current flows. Therefore, by connecting the two ends of the ladder resistor circuit to the first and second power source lines through the first and second switching circuits and controlling the on/off state of the two ends by the first and second switching control signals, low power consumption can be achieved.

Further, the reference voltage generation circuit according to this embodiment may include first to i-th reference voltage output switching circuits respectively inserted between the first to i-th division nodes and first to i-th reference voltage output nodes for outputting the first to i-th reference voltages, and on/off state of the first to i-th reference voltages output switching circuits may be controlled based on one of the first and second switching control signals.

According to this embodiment, by the first or the second switching control signal for electrically disconnecting the ladder resistor circuit, the respective division nodes and the respective reference voltage output nodes are electrically disconnected and therefore, it can be avoided that the respective reference voltage output nodes once driven to given voltages are electrically connected to another reference voltage output node via the ladder resistor circuit to thereby change the voltage. Therefore, it is not necessary to drive the respective reference voltage output nodes again to the reference voltages in accordance with resistance ratios and therefore, unnecessary charging time can be cut and low power consumption can be achieved.

Further, in the reference voltage generation circuit according to this embodiment, the first and second switching circuits may be switched on by the first and second switching control signals during a given driving period based on the first to i-th reference voltages, and the first and second switching circuits may be switched off during a period other than the driving period.

According to this embodiment, multi-valued reference voltages can be generated by flowing current only when the reference voltages are necessary and therefore, consumption of current flowing to the ladder resistor circuit can be minimized.

Further, in the reference voltage generation circuit according to this embodiment, the first and second switching control signals may be generated by using an output enable signal and a latch pulse signal, the output enable signal controlling drive of a signal electrode, and the latch pulse signal indicating a timing of scan period.

According to this embodiment, since the first and second switching control signals are generated by the output enable signal and the latch pulse signal used in a signal driver, consumption of current flowing to the ladder resistor circuit can be restrained without providing an added circuit.

Further, in the reference voltage generation circuit according to this embodiment, the first and second switching circuits may be switched off by the first and second switching control signals, when all blocks are set to a non-display state by partial block selection data for setting display lines of a display panel to a display state or the non-display state for each of the blocks formed of a plurality of signal electrodes, each of the display lines corresponding with each of the signal electrodes in each of the blocks.

According to this embodiment, when a partial display area and a partial non-display area are set for each block by constituting one block by a given number of the signal electrodes, the respective switching circuits are switched off by the first and second switching control signals in the case in which drive voltage based on gray scale data is not outputted to the signal electrode. That is, when all of the blocks are set to the partial non-display area by the partial block selection data, consumption of current flowing to the ladder resistor circuit can be restrained by switching the respective switching circuits off.

A display drive circuit according to another embodiment of the present invention includes:

any of the above-described reference voltage generation circuits;

a voltage selection circuit which selects a voltage based on gray scale data, from the multi-valued reference voltages generated by the reference voltage generation circuit; and a signal electrode drive circuit which drives a signal electrode by using the voltage selected by the voltage selection circuit.

According to this display drive circuit, low power consumption of the display drive circuit that realizes gray scale display by carrying out gamma correction in accordance with a given display characteristic can be achieved.

A display drive circuit according to a further embodiment of the present invention includes:

a partial block selection register which holds partial block selection data for setting display lines of a display panel to a display state or a non-display state for each of blocks formed of a plurality of signal electrodes, each of the display lines corresponding with each of the signal electrodes in each of the blocks;

the above-described reference voltage generation circuit which generates a reference voltage for driving the signal electrodes for each of the blocks based on the partial block selection data;

a voltage selection circuit which selects a voltage based on gray scale data, from the multi-valued reference voltages generated by the reference voltage generation circuit; and a signal electrode drive circuit which drives a signal electrode by using the voltage selected by the voltage selection circuit.

This display drive circuit, capable of setting the partial display area and the partial non-display area for each of the block, can realize both gray scale display produced by carrying out gamma correction in accordance with the given display characteristic and low power consumption.

A display device according to a still further embodiment of the present invention includes:

a plurality of signal electrodes;

a plurality of scan electrodes intersecting with the signal electrodes;

a pixel specified by one of the signal electrodes and one of the scan electrodes;

the above-described display drive circuit which drives the signal electrodes; and a scan electrode drive circuit which drives the scan electrodes.

This display device can realize both the gray scale display produced by carrying out gamma correction in accordance with the given display characteristic and low power consumption.

A display device according to a yet further embodiment of the present invention comprises:

a display panel including:

a plurality of signal electrodes, a plurality of scan electrodes intersecting with the signal electrodes, and a pixel specified by one of the signal electrodes and one of the scan electrodes;

the above-described display drive circuit which drives the signal electrodes; and a scan electrode drive circuit which drives the scan electrodes.

This display device can realize both the gray scale display produced by carrying out gamma correction in accordance with the given display characteristic and low power consumption.

An even further embodiment of the present invention relates to a reference voltage generation method for generating multi-valued reference voltages for generating a gray scale value corrected by gamma correction based on gray scale data, the method comprising:

electrically connecting two opposed ends of a ladder resistor circuit with first and second power source lines, respectively, the ladder resistor circuit outputting voltages of first to i-th division nodes ("i" is an integer larger than or equal to 2) as first to i-th reference voltages, the first to i-th division nodes being formed by dividing the ladder resistor circuit by a plurality of resistor circuits connected in series, the first and second power source lines being supplied with first and second power source voltages, respectively, during a given driving period based on the first to i-th reference voltages, and electrically disconnecting the two ends of the ladder resistor circuit from the first and second power source lines, during a period other than the driving period.

With this method, the voltages of the first to i-th division nodes subjected to resistor division by the respective resistor circuits can be outputted from the ladder resistor circuit constituted by connecting a plurality of resistor circuits in series as the first to i-th reference voltages. Further, only during the given driving period based on the first to i-th reference voltages, the ladder resistance circuit is electrically connected to the first and second power source lines supplied with the first and second power source voltages and during a time period other than the driving period, the two ends of the ladder resistor circuit and the first and second power source lines are electrically disconnected. Thereby, during a time period of not driving by using the reference voltages outputted from the ladder resistor circuit, consumption of current flowing to the ladder resistor circuit can be cut and therefore, low power consumption can be achieved.

This reference voltage generation method may include:

electrically connecting the first to i-th division nodes with first to i-th reference voltage output nodes that outputs the first to i-th reference voltages, during the driving period; and electrically disconnecting the first to i-th division nodes from the first to i-th reference voltage output nodes, during the period other than the driving period.

According to this method, since during the time period of not driving by using the reference voltages, each of the division nodes and each of the reference voltage output nodes are electrically disconnected, there can be avoided a change in the voltage by electrically connecting the driven reference voltage output nodes to other reference voltage output nodes through the ladder resistor circuit. Therefore, it is not necessary to drive the reference voltage output nodes again to the reference voltages in accordance with resistance ratios and therefore, unnecessary charging time can be omitted and low power consumption can be achieved.

A detailed description will be given of embodiments in reference to the drawings as follows.

A reference voltage generation circuit according to the embodiment can be used as a gamma correction circuit. The gamma correction circuit is included in a display drive circuit. The display drive circuit can be used in driving an electro-optical device for changing an optical characteristic by applied voltage, for example, a liquid crystal device.

Although a description will be given of a case of applying a reference voltage generation circuit according to the embodiment to a liquid crystal device as follows, the invention is not limited thereto but applicable to other display device.

1. Display Device

FIG. 1 shows an outline of a constitution of a display device to which a display drive circuit including a reference voltage generation circuit according to the embodiment is applied.

A display device (in narrow sense, electro-optical device, liquid crystal device) 10 can include a display panel (in narrow sense, liquid crystal panel) 20.

The display panel 20 is formed on, for example, a glass substrate. There are arranged scan electrodes (gate lines) $G_1$ to $G_N$ (N is a natural number larger than or equal to 2) arranged in Y-direction and extending in X-direction and signal electrodes (source line) $S_1$ to $S_M$ (M is a natural number larger than or equal to 2) arranged in X-direction and extending in Y-direction. Further, a pixel region (pixel) is provided in correspondence with an intersection of a scan electrode $G_n$ (1%n%N, n is a natural number) and a signal electrode $S_m$ (1%m%M, m is a natural number) and a thin film transistor (hereinafter, abbreviated as TFT) $\mathbf{22}_{nm}$ is arranged at the pixel region.

A gate electrode of TFT $\mathbf{22}_{nm}$ is connected to the scan electrode $G_n$. A source electrode of TFT $\mathbf{22}_{nm}$ is connected to the signal electrode $S_m$. A drain electrode of TFT $\mathbf{22}_{nm}$ is connected to a pixel electrode $\mathbf{26}_{nm}$ of a liquid crystal capacitor (in a broad sense, a liquid crystal element) $\mathbf{24}_{nm}$.

The liquid crystal capacitor $\mathbf{24}_{nm}$ is formed by sealing liquid crystals between the pixel electrode $\mathbf{26}_{nm}$ and an opposed electrode $\mathbf{28}_{nm}$ opposed thereto and the transmittance of the pixel is changed in accordance with voltage applied between the electrodes. The opposed electrode $\mathbf{28}_{nm}$ is supplied with opposed electrode voltage Vcom.

The display device 10 can include a signal driver IC 30. As the signal driver IC 30, a display drive circuit according to the embodiment can be used. The signal driver IC 30 drives the signal electrodes $S_1$ to $S_M$ of the display panel 20 based on image data.

The display device 10 can include a scan driver IC 32. The scan driver IC 32 successively drives the scan electrodes $G_1$ to $G_N$ of the display panel 20 in one vertical scan period.

The display device 10 can include a power source circuit 34. The power source circuit 34 generates voltage necessary for driving the signal electrode and supplies the voltage to the signal driver IC 30. Further, the power source circuit 34 generates voltage necessary for driving the scan electrode and supplies the voltage to the scan driver IC 32. Further, the power source circuit 34 can generate the opposed electrode voltage Vcom.

The display device 10 can include a common electrode drive circuit 36. The common electrode drive circuit 36 is supplied with the opposed electrode voltage Vcom generated by the power source circuit 34 and outputs the opposed electrode voltage Vcom to the opposed electrode of the display panel 20.

The display device 10 can include a signal control circuit 38. The signal control circuit 38 controls the signal driver IC 30, the scan driver IC 32 and the power source circuit 34 in accordance with content set by a host of a central processing unit (hereinafter, abbreviated as CPU), not illustrated. For example, the signal control circuit 38 sets an operation mode and supplies a vertical synchronizing signal and a horizontal synchronizing signal generated at inside thereof to the signal driver IC 30 and the scan driver IC 32 and controls a polarity inversion timing for the power source circuit 34.

Further, although in FIG. 1, the display device 10 is constituted to include the power source circuit 34, the common electrode drive circuit 36 or the signal control circuit 38, the display device 10 may be constituted by providing at least one of these at outside of the display device 10. Or, the display device 10 can be constituted to include a host.

Further, in FIG. 1, at least one of a display drive circuit having a function of the signal driver IC 30 and a scan electrode drive circuit having a function of the scan driver IC 32 may be formed on a glass substrate formed with the display panel 20.

In the display device 10 having such a constitution, the signal driver IC 30 outputs voltage in correspondence with gray scale data to the signal electrode to display gray scale based on the gray scale data. The signal driver IC 30 subjects the voltage to be outputted to the signal electrode to gamma correction based on the gray scale data. For such purpose, the signal driver IC 30 includes a reference voltage generation circuit for carrying out gamma correction (in narrow sense, gamma correction circuit).

Generally, the display panel 20 is provided with a gray scale characteristic which differs in accordance with a structure thereof or a liquid crystal material used. That is, a relationship between voltage to be applied to a liquid crystal and a transmittance of a pixel is not constant. Hence, in order to generate optimum voltage to be applied to a liquid crystal in accordance with gray scale data, gamma correction is carried out by the reference voltage generation circuit.

In order to optimize voltage outputted based on gray scale data, in gamma correction, multi-valued voltages generated by a ladder resistor are corrected. In such a case, a resistance ratio of a resistor circuit for constituting a ladder resistor is determined to generate voltage designated by a maker of fabricating the display panel 20 or the like.

2. Signal Driver IC

Figure 2:
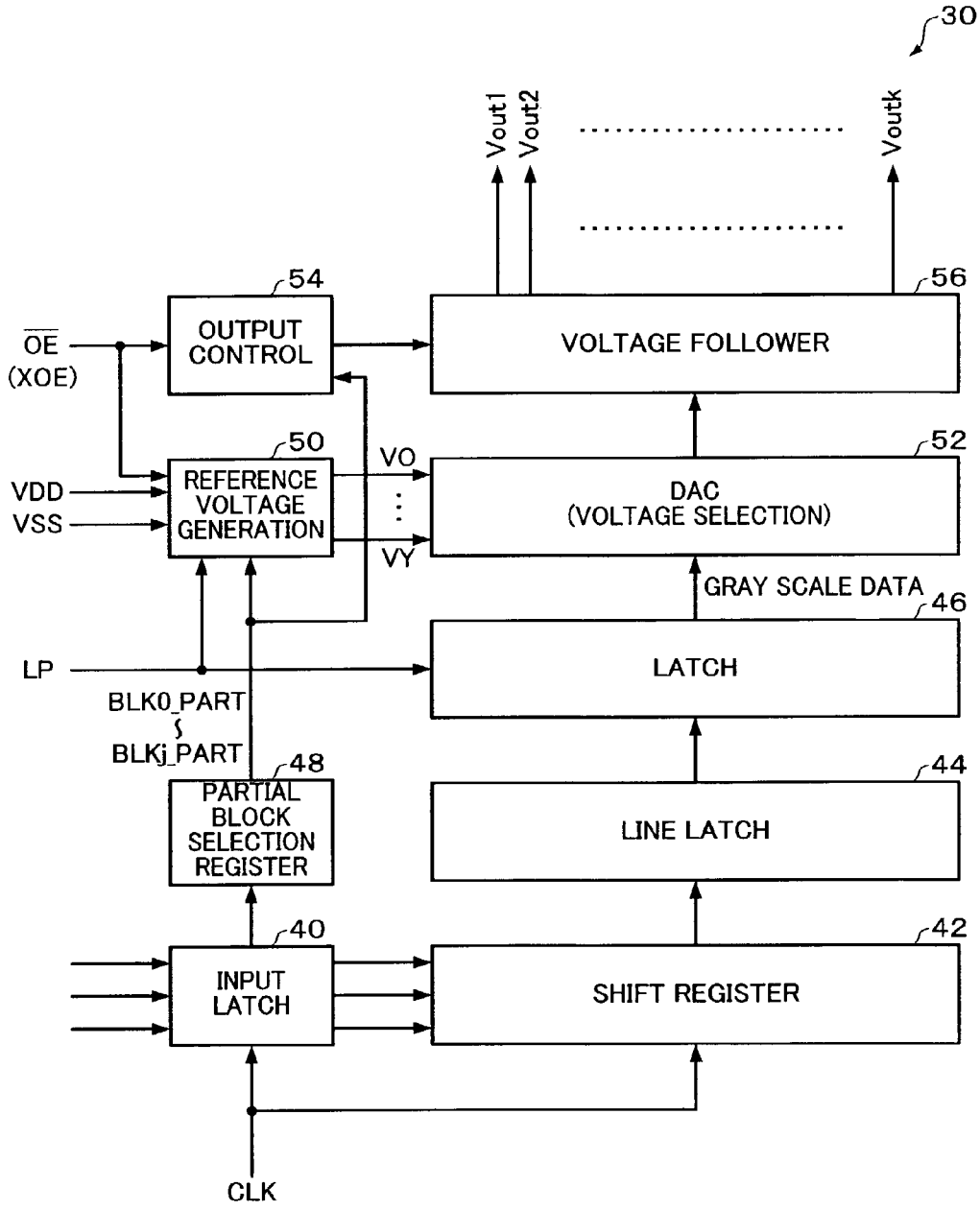
FIG. 2 is a functional block diagram of a signal driver IC to which a display drive circuit including a reference voltage generation circuit is applied.

FIG. 2 shows a functional block diagram of the signal driver IC 30 to which a display drive circuit including a reference voltage generation circuit according to the embodiment is applied.

The signal driver IC 30 includes an input latch circuit 40, a shift register 42, a line latch circuit 44, a latch circuit 46, a partial block selection register 48, a reference voltage selection circuit (in narrow sense, gamma correction circuit) 50, DAC (Digital/Analog Converter) (in a broad sense, voltage selection circuit) 52, an output control circuit 54 and a voltage follower circuit (in a broad sense, signal electrode drive circuit) 56.

The input latch circuit 40 latches gray scale data comprising RGB signals each comprising 6 bits supplied from the signal control circuit 38 shown in FIG. 1 based on a clock signal CLK. The clock signal CLK is supplied from the signal control circuit 38.

The gray scale data latched by the input latch circuit 40 is successively shifted in the shift register 42 based on the clock signal CLK. The gray scale data inputted by being successively shifted in the shift register 42 is inputted to the line latch circuit 44.

The gray scale data inputted to the line latch circuit 44 is latched by the latch circuit 46 at a timing of a latch pulse signal LP. The latch pulse signal LP is inputted at a horizontal scan period timing.

The partial block selection register 48 holds partial block selection data. The partial block selection data is set via the input latch circuit 40 by a host, not illustrated. When 1 block is constituted by, for example, 24 outputs (for 8 pixels when 1 pixel comprises 3 dots of R, G, B) of a plurality of signal electrodes driven by the signal driver IC 30, the partial block selection data is data for setting a display line in correspondence with signal electrodes by a unit of block to a display state or a non-display state.

Figure 3A:
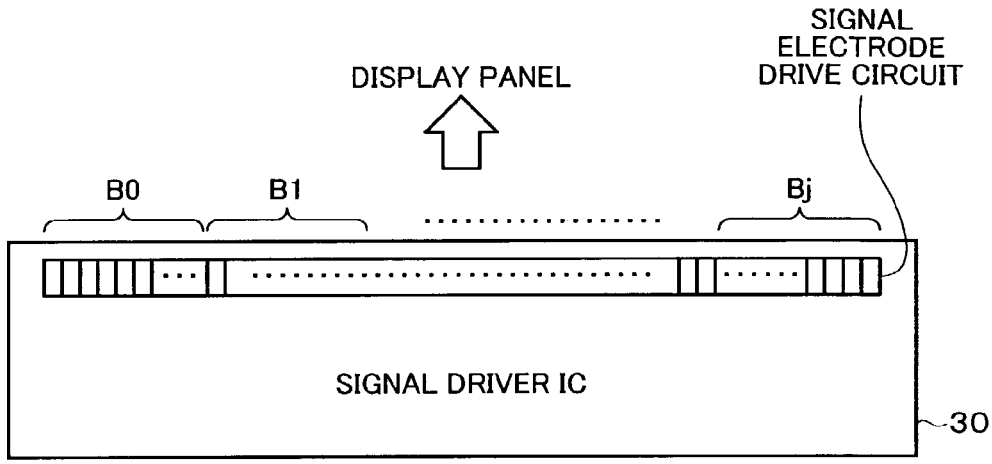
FIG. 3A is a schematic view of a signal driver IC for driving a signal electrode by a unit of block and FIG. 3B shows an outline of a partial block selection register.
Figure 3B:
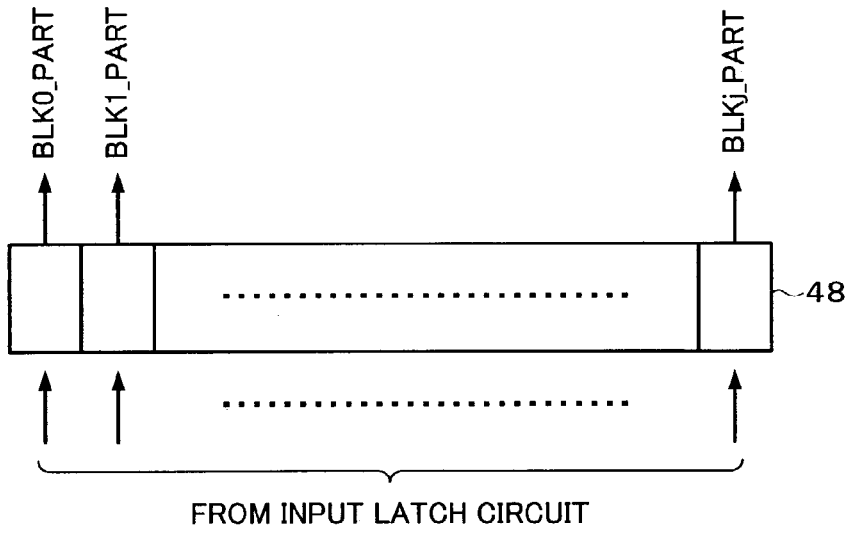

FIG. 3A schematically shows the signal driver IC 30 for driving signal electrodes by a unit of block and FIG. 3B shows an outline of a partial block selection register 48.

According to the signal driver IC 30, as shown by FIG. 3A, signal electrode drive circuits are arranged in a long side direction in correspondence with signal electrodes of a display panel constituting an object for driving. The signal electrode drive circuits are included in the voltage follower circuit 56 shown in FIG. 2. The partial block selection register 48 shown in FIG. 3B holds partial block selection data for setting display lines to the display state or the non-display state for each of blocks. Each of the blocks is formed of the display lines corresponding to the signal electrodes for "k" (for example "24") outputs of signal electrode drive circuits. In this case, the signal electrode drive circuits are divided into blocks B0 to Bj (j is a positive integer of 1 or more) and the partial block selection register 48 is inputted with partial block selection data BLK0_PART to BLKj_PART in correspondence with the respective blocks from the input latch circuit 40. When partial block selection data BLKz_PART (0%z%j, z is an integer) is, for example, "1", the display line in correspondence with the signal electrodes of the block Bz is set to the display state. When the partial block selection data BLKz_PART is, for example, "0", the display line in correspondence with the signal electrodes of the block Bz is set to the non-display state.

Figure 4:
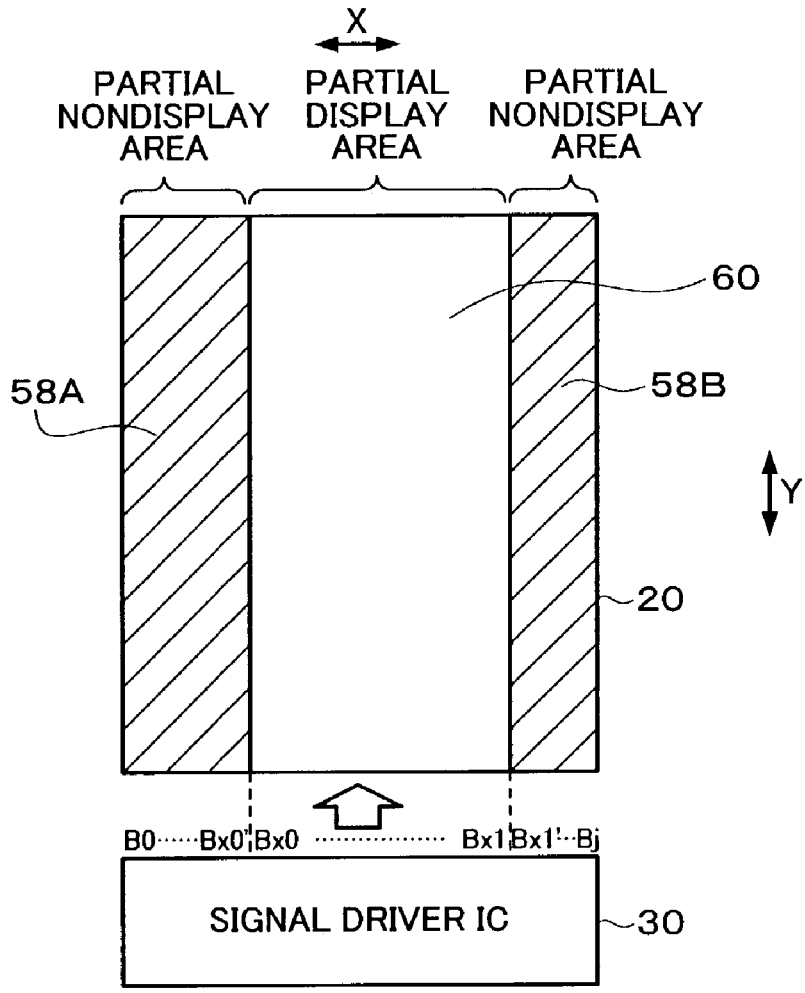
FIG. 4 is a view schematically showing vertical band partial display.

The signal driver IC 30 outputs drive voltage in correspondence with gray scale data to signal electrodes of a block set to the display state. Further, signal electrodes of a block set to the non-display state are outputted with, for example, a given drive voltage and display in correspondence with gray scale data is not carried out. For example, when display lines in correspondence with signal electrodes of blocks B0 to Bx0 and Bx1 to Bj are set to the non-display state, and a display line in correspondence with signal electrodes of blocks Bx0' to Bx1' (X0'=x0+1, x1'=x1−1), partial non-display areas 58A and 58B and a partial display area 60 are provided and partial display of vertical bands can be carried out on the display panel 20 as shown by FIG. 4.

In FIG. 2, by using resistance ratios of ladder resistors determined to optimize gray scale display of the display panel constituting the object for driving, the reference voltage generation circuit 50 outputs multi-valued reference voltages V0 to VY (Y is a natural number) generated at division nodes produced by dividing a resistor between power source voltage on a high potential side (first power source voltage) V0 and power source voltage on a low potential side (second power source voltage) VSS.

Figure 5:
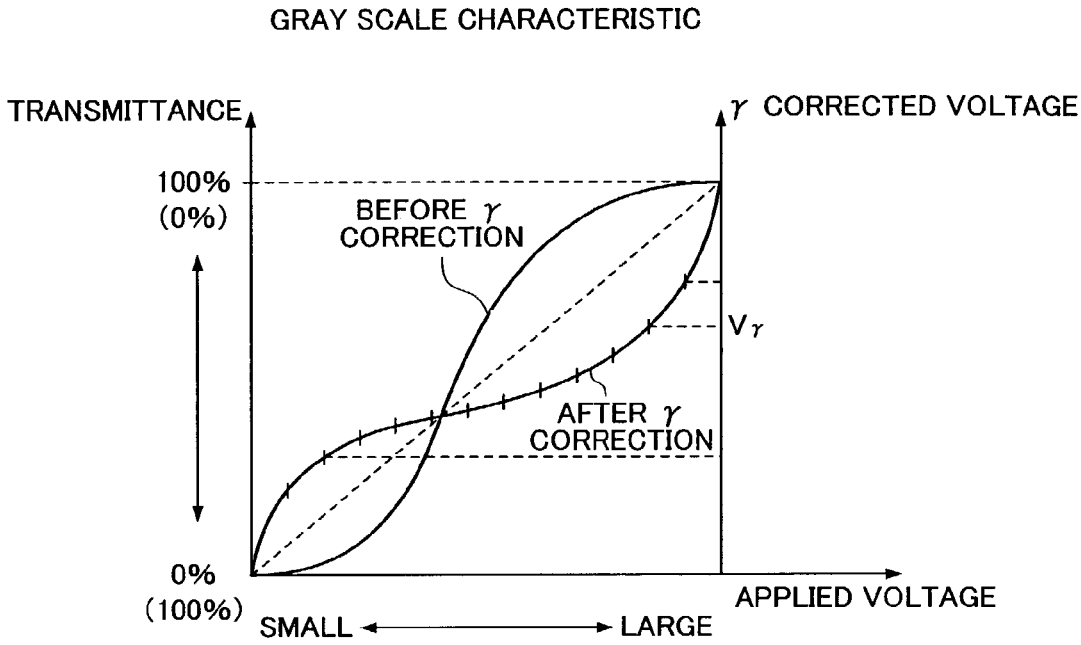
FIG. 5 is a view for describing principle of gamma correction.

FIG. 5 shows a diagram for describing principle of gamma correction.

A diagram of a gray scale characteristic showing a change in a transmittance of a pixel to voltage applied to a liquid crystal is shown here. When the transmittance of a pixel is designated by 0% to 100% (or 100% to 0%), generally, the smaller or the larger the voltage applied to the liquid crystal, the smaller the change in the transmittance. Further, the change in the transmittance is increased at a region at a vicinity of a middle of the voltage applied to the liquid crystal.

Hence, by carrying out gamma (γ) correction for changing the transmittance reversely to the above-described change in the transmittance, the transmittance subjected the gamma correction which is changed linearly in accordance with the applied voltage can be realized. Therefore, reference voltage Vγ for realizing an optimized transmittance can be generated based on gray scale data which is digital data. That is, the resistance ratios of the ladder resistors may be realized to generate such reference voltage.

Multi-valued reference voltages V0 to VY generated by the reference voltage generation circuit 50 in FIG. 2 are supplied to DAC 52.

DAC 52 selects any voltages of multi-valued reference voltages V0 to VY based on the gray scale data supplied from the latch circuit 46 and outputs the voltages to the voltage follower circuit (in a broad sense, signal electrode drive circuit) 56.

The output control circuit 54 controls an output of the voltage follower circuit 56 by using an output enable signal XOE for controlling to drive the signal electrode and partial block selection data BLK0_PART to BLKj_PART.

The voltage follower circuit 56 carries out, for example, impedance conversion to drive corresponding signal electrodes in accordance with a control by the output control circuit 54.

In this way, the signal driver IC 30 outputs the signals by carrying out impedance conversion by using voltages selected from multi-valued reference voltages based on gray scale data for respective signal electrodes.

Meanwhile, the reference voltage generation circuit 50 can control current flowing in the ladder resistor based on at least one of the output enable signal XOE, the latch pulse signal LP indicating a horizontal scan period timing (in a broad sense, scan period of timing) and partial block selection data BLK0_PART to BLKj_PART. Thereby, current can be made to flow to the ladder resistor only during a time period of displaying gray scale based on the generated reference voltage and low power consumption can be achieved.

Next, the reference voltage generation circuit 50 will be described in details.

3. Reference Voltage Generation Circuit

Figure 6:
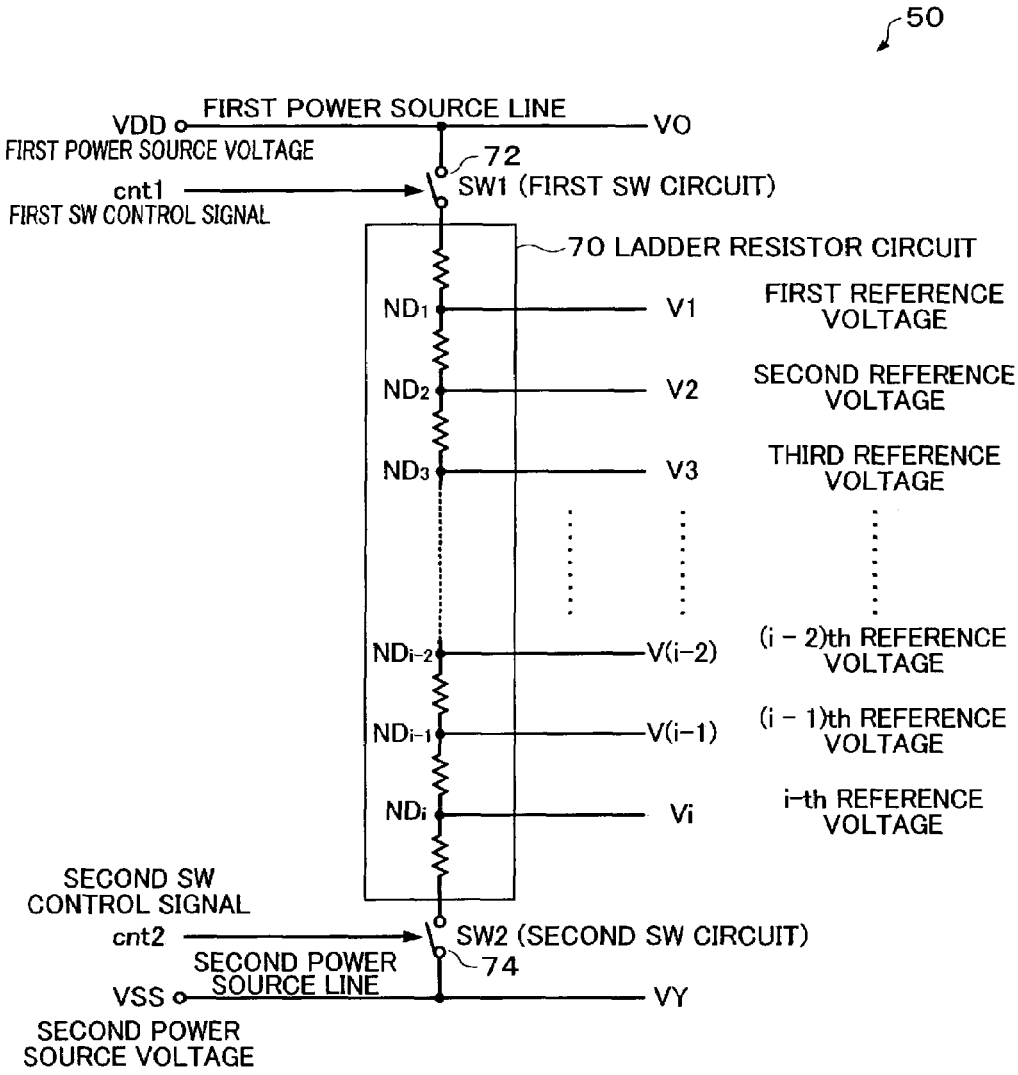
FIG. 6 is a constitutional diagram showing a principle constitution of a reference voltage generation circuit.

FIG. 6 shows a principle constitution of the reference voltage generation circuit 50.

The reference voltage generation circuit 50 includes a ladder resistor circuit 70 connected with a plurality of resistor circuits in series. Each of the resistor circuits constituting the ladder resistor circuit 70 can be constituted by, for example, a single or a plurality of resistor elements. Further, each of the resistor circuits can also be constituted to make a resistor value thereof variable by connecting resistor elements or resistor elements and a single or a plurality of switching elements in series or in parallel.

The ladder resistor circuit 70 is divided by the resistor circuits to form first to i-th (i is an integer larger than or equal to 2) division nodes $ND_1$ to $ND_i$. Voltages of the first to i-th division nodes $ND_1$ to $ND_i$ are outputted to first to i-th reference voltage output nodes as multi-valued first to i-th reference voltages V1 to Vi. DAC 52 is supplied with first to i-th reference voltages V1 to Vi and reference voltages V0 and VY (=VSS).

The reference voltage generation circuit 50 includes first and second switching circuits (SW1, SW2) 72 and 74. The first switching circuit 72 is inserted between one end of the ladder resistor circuit 70 and a first power source line supplied with power source voltage (first power source voltage) V0 on the high potential side. The second switching circuit 74 is inserted between other end of the ladder resistor circuit 70 and a second power source line supplied with power source voltage (second power source voltage) VSS on the low potential side. On/off state of the first switching circuit 72 is controlled based on a first switching control signal cnt1. On/off state of the second switching circuit 74 is controlled based on a second switching control signal cnt2. The first and second switching circuits 72 and 74 can be constituted by, for example, MOS transistors. The first and second switching control signals cnt1 and cnt2 may be generated based on the same given control signal or may be generated as separate control signals.

The reference voltage generation circuit 50 having such a constitution can restrain consumption of current flowing to the ladder resistor circuit 70 by controlling off state of the first and second switching circuits 72 and 74 by the first and second switching control signals (first or second switching control signal when the first and second switching circuits 72 and 74 are controlled by the same switching control signal) during a time of, for example, not driving by using first to i-th reference voltages V1 to Vi outputted from the ladder resistor circuit 70 (given driving period based on first to i-th reference voltages).

3.1 First Constitution Example

Figure 7:
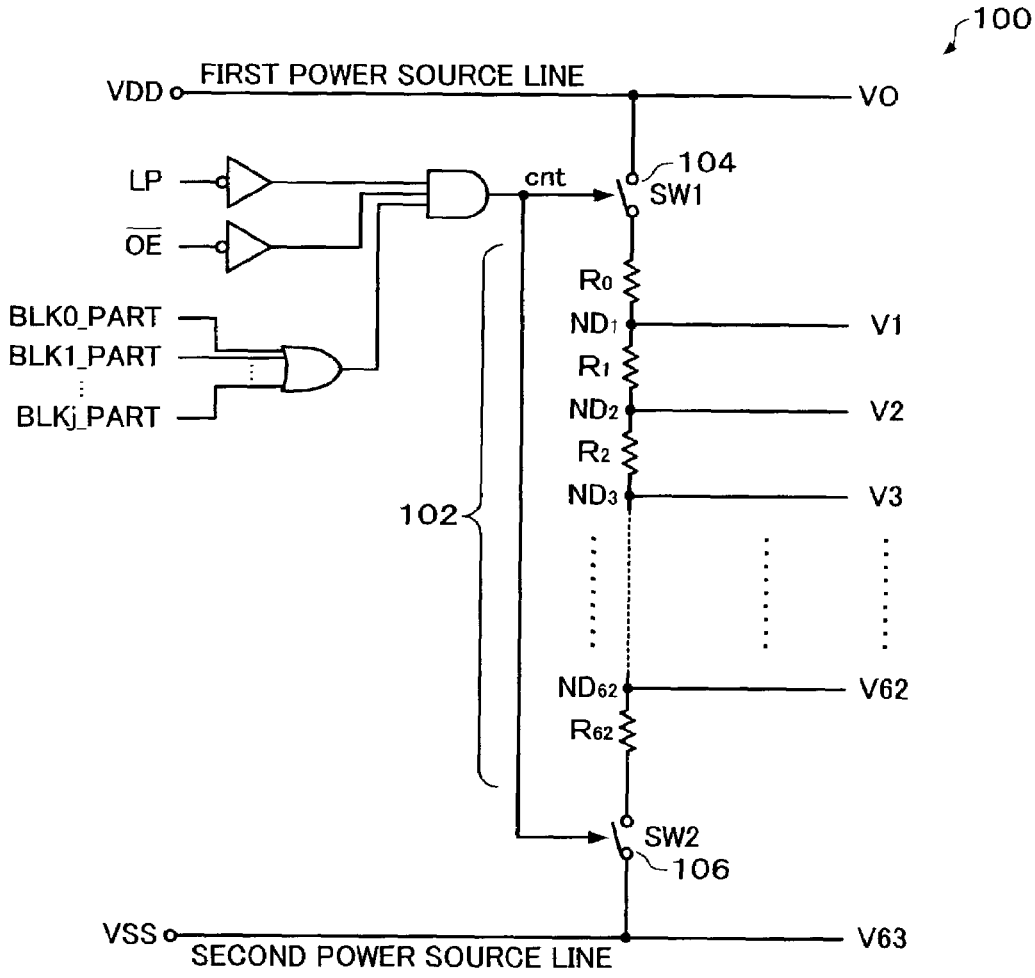
FIG. 7 is a constitutional diagram schematically showing a constitution of a reference voltage generation circuit according to a first constitution example.

FIG. 7 shows an outline of a constitution of a reference voltage generation circuit according to a first constitution example.

A reference voltage generation circuit 100 according to the first constitution example includes a ladder resistor circuit 102. The ladder resistor circuit 102 includes resistor circuits (in narrow sense, resistor elements) $R_0$ to $R_i$ connected in series and first to i-th reference voltages V1 to Vi are outputted from first to i-th division nodes $ND_1$ to $ND_i$ which are formed by dividing the ladder resistor circuit by the resistor circuits $R_0$ to $R_i$.

In FIG. 7, reference voltage V0 to V63 necessary for displaying 64 gray scales are supplied to DAC. Among them, reference voltages V1 to V62 are outputted from the ladder resistor circuit 102 of the reference voltage generation circuit 100. That is, the ladder resistor circuit 102 includes resistor elements $R_0$ to $R_{62}$ connected in series and first to 62nd reference voltages V1 to V62 are outputted from first to 62nd division nodes $ND_1$ to $ND_{62}$ which are formed by dividing the ladder resistor circuit by the resistor elements $R_0$ to $R_{62}$. Further, resistance values of the resistor elements $R_0$ to $R_{62}$ can realize resistance ratios determined in accordance with a gray scale characteristic shown in, for example, FIG. 5.

A first switching circuit (SW1) 104 is inserted between one end of the resistor element $R_0$ constituting the ladder resistor circuit 102 and the first power source line. A second switching circuit (SW2) 106 is inserted between one end of the resistor element $R_{62}$ constituting the ladder resistor circuit 102 and the second power source line. The first and second switching circuits 104 and 106 are controlled by a switching control signal cnt. In this case, when a logical level of the switching control signal cnt is "L", the first and second switching circuits 104 and 106 are switched off to thereby electrically disconnect the both ends and when the logical level of the switching control signal cnt is "H", the first and second switching circuits 104 and 106 are switched on to thereby electrically connect the both ends.

The switching control signal cnt is generated based on the output enable signal XOE, the latch pulse signal LP and the partial block selection data BLK0_PART to BLKj_PART of each of the blocks.

When the output enable signal XOE is at logical level of "H", the voltage follower circuit 56 controlled by the output control circuit 54 brings output to signal electrodes into a high impedance state. When the output enable signal XOE is at logical level of "L", the voltage follower circuit 56 controlled by the output control circuit 54 outputs a given drive voltage to signal electrode. Therefore, when the output enable signal XOE is at logical level of "H", the signal electrode is not driven by using first to 62nd reference voltages V1 to V62. Therefore, by cutting current flowing to the crystal circuit 102 during the time period, gray scale display corrected by the gamma correction can be carried out and current flowing to the ladder resistor circuit can be minimized.

The latch pulse signal LP is a signal specifying, for example, one horizontal scan period timing and is a signal by which the logical level becomes "H" after a given horizontal scan time period. The signal driver IC 30 drives signal electrode with a rise edge of the latch pulse signal LP as a reference. Therefore, the signal electrode is not driven by using first to 62nd reference voltages V1 to V62 when the logical level of the latch pulse signal LP is "H". Therefore, by cutting current flowing to the ladder resistor circuit 102 during the time period, gray scale display corrected by gamma correction can be carried out and current flowing to the ladder resistor circuit can be minimized.

Partial block selection data BLK0_PART to BLKj_PART are data for setting display lines in correspondence with signal electrodes of the block to a display state or a non-display state by a unit of block constituting the unit by a given number of signal electrodes. That is, a display line in correspondence with a signal electrode of a block set to a non-display state becomes a partial non-display area and the signal electrode is not driven by using first to 62nd reference voltages V1 to V62. Therefore, when display lines in correspondence with signal electrodes of all the blocks are set to the non-display state by partial block selection data BLK0_PART to BLKj_PART (when BLK0_PART to BLKj_PART are all "0" (logical level "L")), by cutting current flowing to the ladder resistor circuit 102, gray scale display corrected by gamma correction can be carried out and current flowing to the ladder resistor circuit can be minimized.

Figure 8:
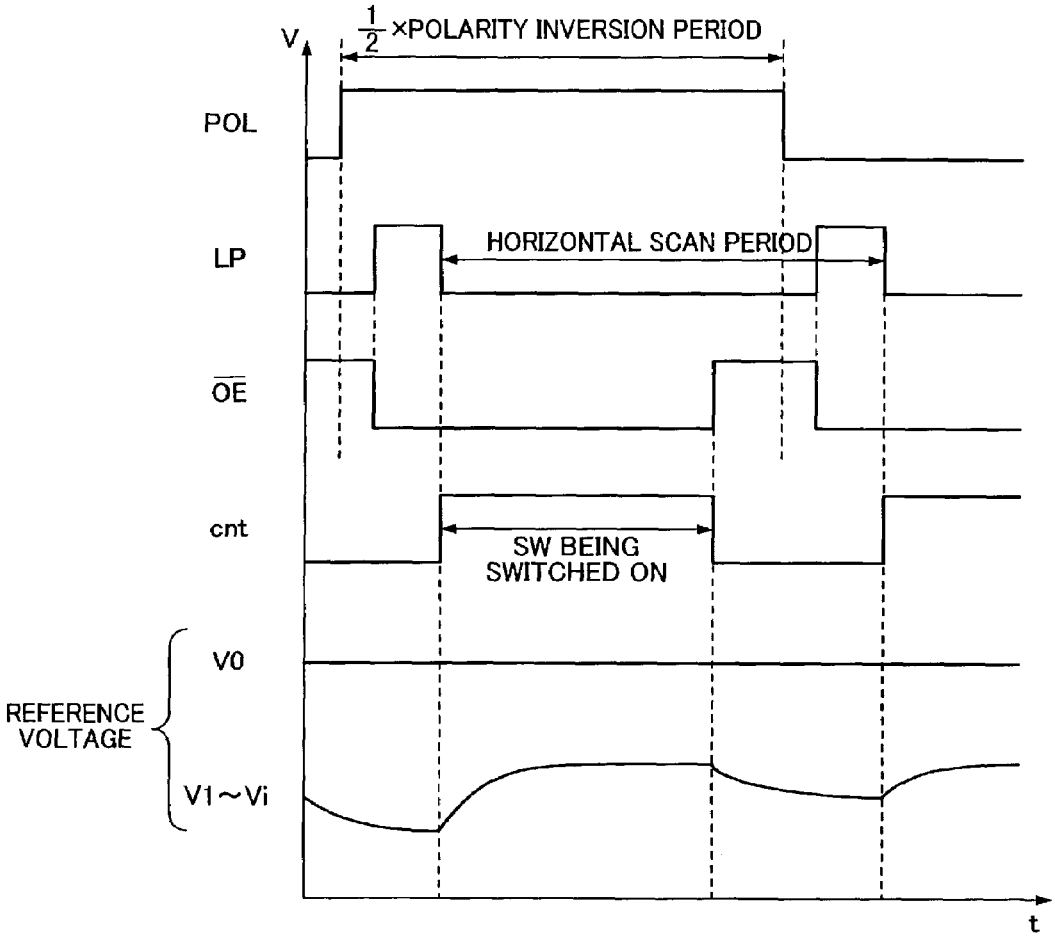
FIG. 8 is a timing chart showing an example of a control timing of the reference voltage generation circuit according to the first constitution example.

FIG. 8 shows an example of a control timing of the reference voltage generation circuit 100 according to the first constitution example.

An example of a control timing in correspondence with a period for inverting a polarity of applied voltage of a liquid crystal (in a broad sense, display element) specified by a polarity inverting signal POL is shown here.

As described above, the switching control signal cnt can be generated by using the output enable signal XOE, the latch pulse signal LP and the partial block selection data BLK0_PART to BLKj_PART. Based on the switching control signal cnt, on/off state of the first and second switching circuits 104 and 106 can be controlled. When a consideration is given to a case in which the signal driver IC 30 drives a signal electrode with a fall edge of the latch pulse signal LP as a reference, only during a time period in which the logical level of the switching control signal cnt is at "H", current flows to the ladder resistor circuit 102 and consumption of current can be minimized.

3.2 Second Constitution Example

Figure 9:
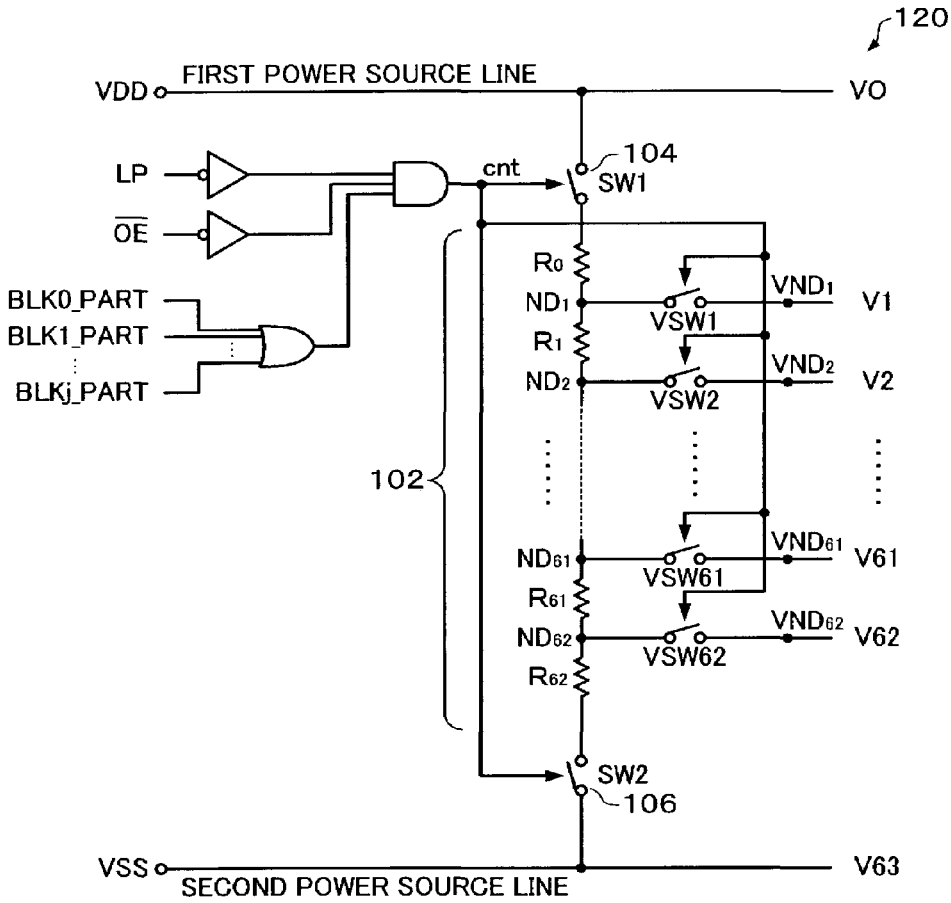
FIG. 9 is a constitutional diagram schematically showing a constitution of a reference voltage generation circuit according to a second constitution example.

FIG. 9 shows an outline of a constitution of a reference voltage generation circuit according to a second constitution example.

Note that the same notations are attached to portions the same as those of the reference voltage generation circuit 100 according to the first constitution example and a description thereof will pertinently be omitted.

A point at which the reference voltage generation circuit 120 according to the second constitution example differs from the reference voltage generation circuit 100 according to the first constitution example, resides in that first to i-th reference voltage output switches VSW1 to VSWi are inserted between first to i-th division nodes $ND_1$ to $ND_i$ and first to i-th reference voltage output nodes $VND_1$ to $VND_i$ for outputting first to i-th reference voltages V1 to Vi. On/off state of the first to i-th reference voltage output switches VSW1 to VSWi are controlled by the switching control signal cnt for controlling on/off state of the first and second switching circuits 104 and 106 (in abroad sense, first or second switching control signal).

In FIG. 9, reference voltages V0 to V63 necessary for displaying 64 gray scales are supplied to DAC. Among them, reference voltages V1 to V62 are outputted from the ladder resistor circuit of the reference voltage generation circuit. That is, the point at which the reference voltage generation circuit 120 according to the second constitution example differs from the reference voltage generation circuit 100 according to the first constitution example, resides in that first to 62nd reference voltage output switches VSW1 to VSW62 are inserted between first to 62nd division nodes $ND_1$ to $ND_{62}$ and first to 62nd reference voltage output nodes $VND_1$ to $VND_{62}$ for outputting first to 62nd reference voltages V1 to V62. On/off state of the first to 62nd reference voltage output switches VSW1 to VSW62 are controlled by the switch controlling signal cnt for controlling on/off state of the first and second switching circuits 104 and 106.

In the first constitution example shown by, for example, FIG. 7, consider a case in which the first and second switching circuits 104 and 106 are switched off in a state in which voltages of first to 62nd division nodes $ND_1$ to $ND_{62}$ become inherent reference voltages V1 to V62. At this occasion, voltages of first to 62nd reference voltage output nodes V1 to V62, are changed by flowing current via resistor elements $R_0$ to $R_{62}$ constituting the ladder resistor circuit 102. Therefore, when the first and second switching circuits 104 and 106 are switched on, it is necessary to charge electricity until desired reference voltages are reached again.

Hence, as shown by FIG. 9, by providing first to 62nd reference voltage output switches VSW1 to VSW62, in a state in which the first and second switching circuits 104 and 106 are switched off, first to 62nd reference voltage output nodes $VND_1$ to $VND_{62}$ can electrically be separated from first to 62nd division nodes $ND_1$ to $ND_{62}$ and the above-described phenomenon can be avoided. Therefore, there may be constructed a constitution in which on/off state of the first to 62nd reference voltage output switches VSW1 to VSW62 are controlled similar to the first and second switching circuits 104 and 106.

3.3 Third Constitution Example

The signal driver IC 30 to which the reference voltage generation circuit is applied, drives signal electrodes of the display panel 20 based on gray scale data. The liquid crystal element is provided at the pixel region provided in correspondence with the intersection of the signal electrode and the scan electrode of the display panel 20. With respect to the liquid crystal sealed between the pixel electrode and the opposed electrode of the liquid crystal element, it is necessary to alternately invert a polarity of voltage applied to the liquid crystal at given timings in order to prevent deterioration.

Therefore, also with regard to the reference voltage generation circuit for generating the reference voltage in correspondence with the gray scale characteristic, it is necessary to switch voltage outputted to the signal electrode based on the same gray scale data at every time of inverting the polarity. Therefore, the first and second power source voltages of the reference voltage generation circuit are alternately switched. However, since it is necessary to drive the respective division nodes, which are formed by dividing the ladder resistor circuit by the resistor circuits, at a given reference voltage every time the polarity is inverted, charge and discharge are carried out frequently and there poses a problem that consumption of current is increased.

Hence, a reference voltage generation circuit 200 of the signal driver IC 30 includes a ladder resistor circuit for a positive polarity and a ladder resistor circuit for a negative polarity.

Figure 10:
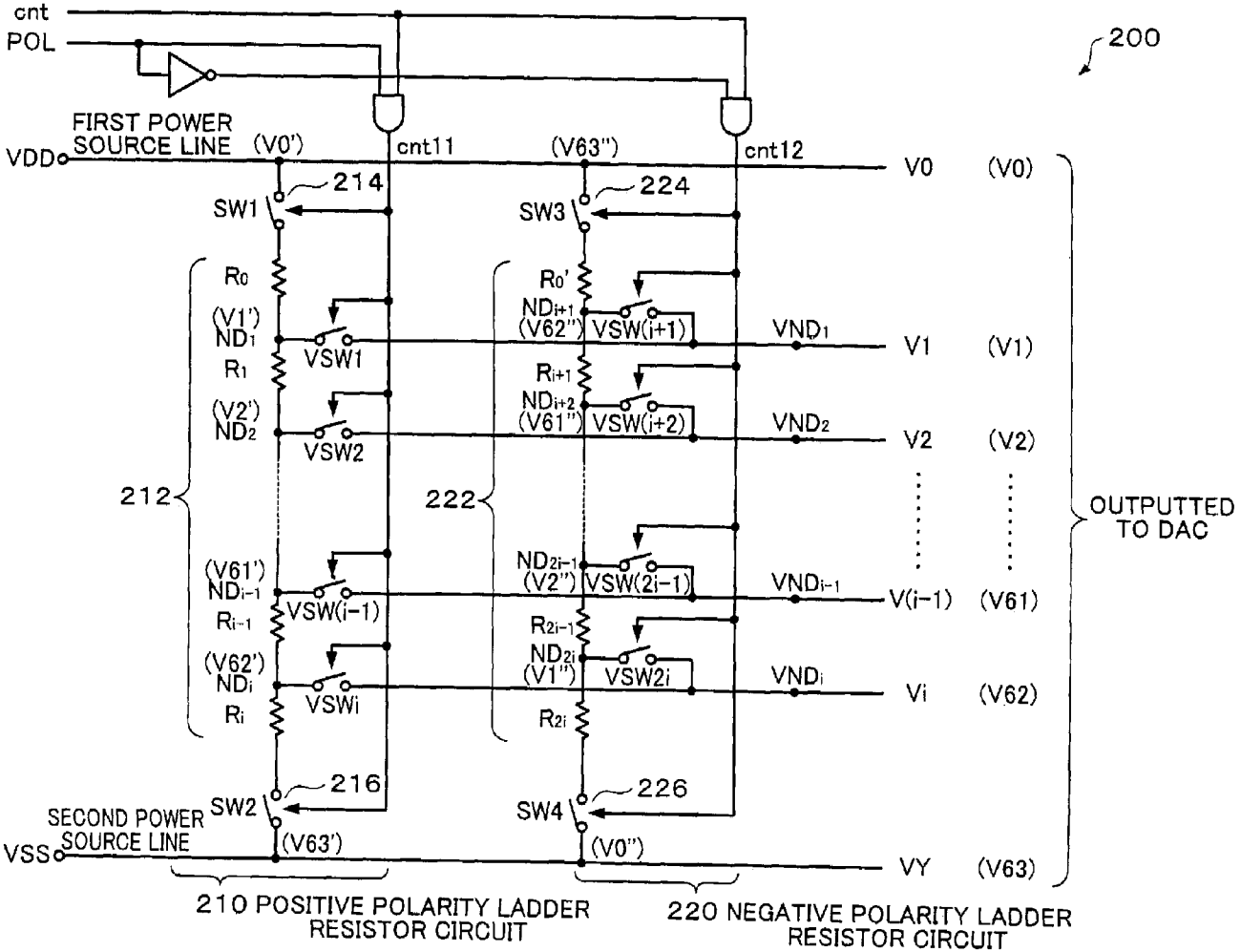
FIG. 10 is a constitutional diagram schematically showing a constitution of a reference voltage generation circuit according to a third constitution example.

FIG. 10 shows an outline of a constitution of the reference voltage generation circuit 200 according to the third constitution example.

The reference voltage generation circuit 200 according to the third constitution example includes a positive polarity ladder resistor circuit 210 and a negative polarity ladder resistor circuit 220. The positive polarity ladder resistor circuit 210 generates reference voltages V1 to Vi used at a positive polarity inversion period when a logical level of polarity inversion signal POL is "H". The negative ladder resistor circuit 220 generates reference voltage V1 to Vi used in a negative polarity inversion period when the logical level of the polarity inversion signal POL is "L". By providing the two ladder resistor circuits and switching to output the reference voltages in the respective polarities in accordance with a given polarity inversion timing, optimum reference voltage in correspondence with the gray scale characteristic which is not generally a symmetric characteristic can be generated and it is not necessary to switch the power source voltages on the high potential side and the low potential side.

Further specifically, the positive polarity ladder resistor circuit 210 and the negative polarity ladder resistor circuit 220 are respectively constructed by a constitution substantially similar to that of the reference voltage generation circuit 120 according to the second constitution example shown in FIG. 9. However, on/off state of the respective switching circuits are controlled to by using the polarity inversion signal POL. Further, regardless of the polarity of the voltage applied to the liquid crystal, the power source voltages on the high potential side and the low potential side (first and second power source voltages) are fixed.

The positive polarity ladder resistor circuit 210 includes a first ladder resistor circuit 212 having resistor circuits connected in series by resistor ratios for the positive polarity. One end of the first ladder resistor circuit 212 is connected to the first power source line supplied with the first power source voltage via a first switching circuit (SW1) 214. Other end of the first ladder resistor circuit 212 is connected to the second power source line supplied with the second power source voltage via a second switching circuit (SW2) 216.

The first to i-th reference voltage output switching circuits VSW1 to VSWi are inserted between first to i-th division nodes $ND_1$ to $ND_i$ which are formed by dividing the ladder resistor circuit by the resistor circuits $R_0$ to $R_i$ constituting the first ladder resistor circuit 212 and first to i-th reference voltage output nodes $VND_1$ to $VND_i$.

On/off state of the first and second switching circuits SW1 and SW2 and first to i-th reference voltage output switching circuits VSW1 to VSWi are controlled by a switching control signal cnt11 (in a broad sense, first switching control signal). The switching control signal cnt11 is generated by calculating a logical product of the switching control signal cnt generated as shown by FIG. 9 and the polarity inversion signal POL. That is, on/off state of the first and second switching circuits SW1 and SW2 and first to i-th reference voltage output switching circuits VSW1 to VSWi are controlled in accordance with the switching control signal cnt when a logical level of the polarity inversion signal POL is "H".

The negative ladder resistor circuit 220 includes a second ladder resistor circuit 222 having resistor circuits connected in series by resistance ratios for the negative polarity. One end of the second ladder resistor circuit 222 is connected to the first power source line via a third switching circuit (SW3) 224. Other end of the second ladder resistor circuit 222 is connected to the second power source line via a fourth switching circuit (SW4) 226.

The (i+1)th to 2i-th reference voltage output switching circuits VSW(i+1) to VSW2i are inserted between (i+1)th to 2i-th division nodes $ND_{i+1}$ to $ND_{2i}$ which are formed by dividing the ladder resistor circuit by the resistor circuits $R_0'$ and $R_{i+1}$ to $R_{2i}$ constituting the second ladder resistor circuit 222 and first to i-th reference voltage output nodes $VND_1$ to $VND_i$.

On/off state of the third and the fourth switching circuits SW3 and SW4 and (i+1)th to 2i-th reference voltage output switching circuits VSW(i+1) to VSW2i are controlled by a switching control signal cnt12 (in a broad sense, second switching control signal). The switching control signal cnt12 is generated by calculating a logical product of the switching control signal cnt generated as shown by FIG. 9 and an inverted signal of the polarity inversion signal POL. That is, on/off state of the third and the fourth switching circuit SW3 and SW4 and (i+1)th to 2i-th reference voltage output switching circuits VSW(i+1) to VSW2i are controlled in accordance with the switching control signal cnt when the logical level of the polarity inversion signal POL is "L".

First to i-th reference voltages V1 to Vi generated by the two ladder resistor circuits and the reference voltages V0 and VY are outputted to DAC as the voltage selection circuit.

Next, a description will be given of a constitution of a circuit for driving signal electrodes by using multi-valued reference voltages generated by the reference voltage generation circuit.

Figure 11:
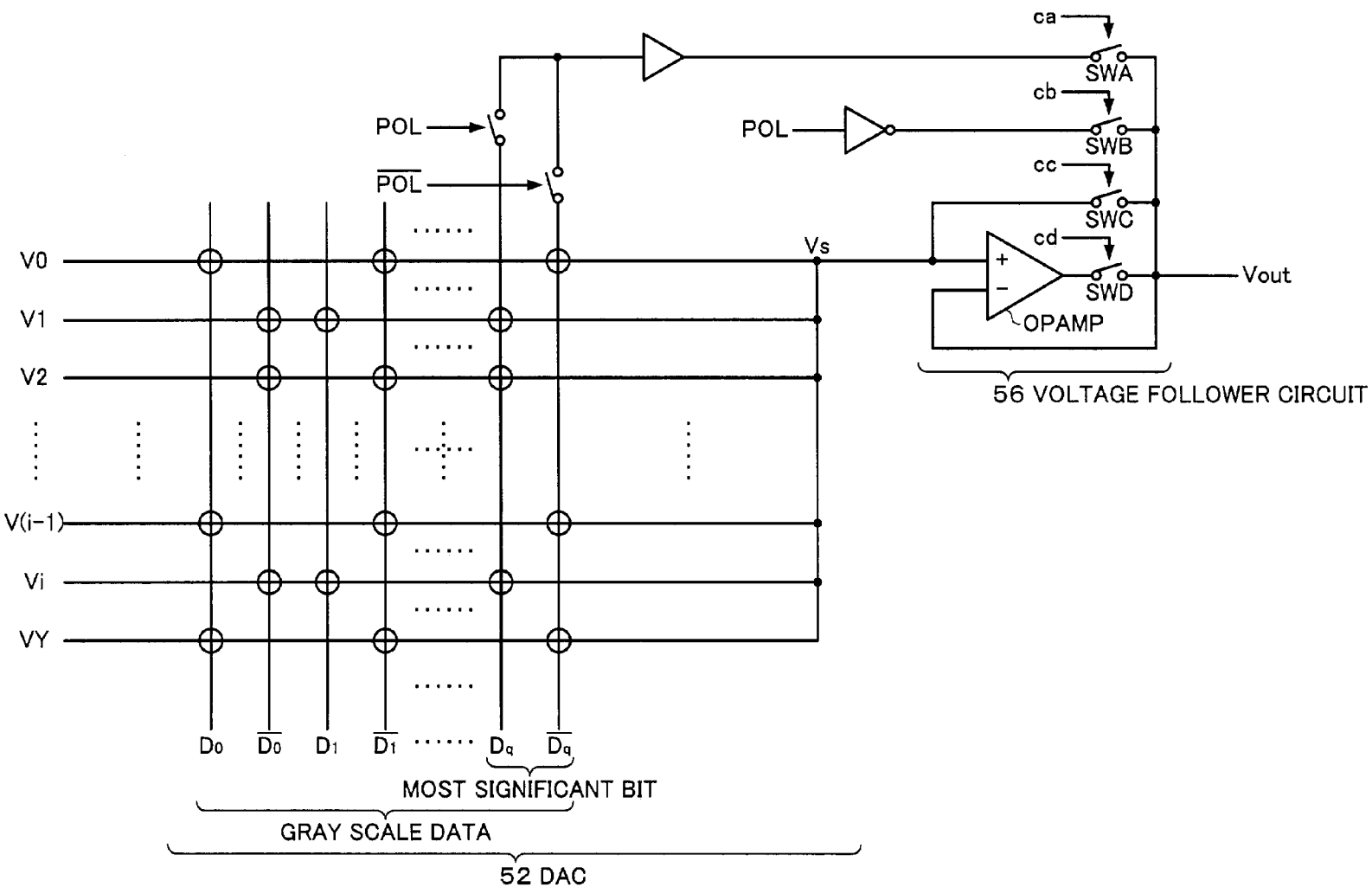
FIG. 11 is a constitutional diagram showing a specific constitution example of DAC and a voltage follower circuit.

FIG. 11 shows a specific constitution example of DAC 52 and the voltage follower circuit 56.

Only a constitution for one output is shown here.

DAC 52 can be realized by an ROM decoder circuit. DAC 52 selects any one of the reference voltages V0 and VY and first to i-th reference voltages V1 to Vi based on gray scale data of (q+1) bits and outputs a selected one as selected voltage Vs to the voltage follower circuit 56.

The voltage follower circuit 56 drives a corresponding signal electrode in accordance with a mode set to either of a normal drive mode and a partial drive mode.

First, DAC 52 will be described. DAC 52 is inputted with gray scale data $D_q$ to $D_0$ of (q+1) bits and inverted gray scale data $XD_q$ to $XD_0$ of (q+1) bits. The inverted gray scale data $XD_q$ to $XD_0$ are produced respectively by inverting bits of the gray scale data $D_q$ to $D_0$. In this case, the gray scale data $D_q$ and the inverted gray scale data $XD_q$ are the most significant bits of the gray scale data and inverted gray scale data, respectively.

In DAC 52, any one of multi-valued reference voltage V0 to Vi and VY generated by the reference voltage generation circuit is selected based on the gray scale data.

For example, assume that the reference voltage generation circuit 200 shown in FIG. 10 generates reference voltages V0 to V63. Further, the reference voltages generated by using the positive polarity ladder resistor circuit 210 are designated by notations V0' to V63'. Further specifically, the first and second power source voltages are set to V0' and V63' and voltages of first to i-th division nodes $ND_1$ to $ND_i$ are set to V1' to V62'.

Further, reference voltages generated by the negative polarity ladder resistor circuit 220 are designated by notations V63" to V0". Further specifically, the first and second power source voltages are set to V63" and V0" and the voltages of (i+1)th to 2i-th division nodes $ND_{i+1}$ to $ND_{2i}$ are set to V62" to V1".

That is, the following relationships are established.

$$V0'=V63''=V0 \quad (1)$$

$$V1'=V62''=V1 \quad (2)$$

$$V2'=V61''=V2 \quad (3)$$

. . .

$$V61'=V2''=V61 \quad (62)$$

$$V62'=V1''=V62 \quad (63)$$

$$V63'=V0''=V63 \quad (64)$$

Assume that when the logical level of the polarity inversion signal POL is "H", the reference voltage V2' (=V2) generated by the positive polarity ladder resistor circuit 210 is selected in correspondence with 6 (q=5) bits of gray scale data $D_5$ to $D_0$ "000010" (=2). In this case, when the logical level of the polarity inversion signal POL becomes "L" at successive polarity inversion timing, the reference voltage is selected by using inverted gray scale data $XD_5$ to $XD_0$ produced by inverting gray scale data $D_5$ to $D_0$. That is, inverted gray scale data $XD_5$ to $XD_0$ becomes "111101" (=61) and reference voltage V61" generated by the negative ladder resistor circuit 220 can be selected. Therefore, in the positive polarity and the negative polarity, as shown by Equation (3), in both of the cases, the second reference voltage V2 is outputted and therefore, it is not necessary to frequently repeat to charge and discharge the reference voltage output node.

The selected voltage Vs selected by DAC 52 in this way is inputted to the voltage follower circuit 56.

The voltage follower circuit 56 includes switching circuits SWA to SWD and an operational amplifier OPAMP. An output of the operational amplifier OPAMP is connected to signal electrode output node via the switching circuit SWD. The signal electrode output node is connected to an inverted input terminal of the operational amplifier OPAMP. The signal electrode output node is connected to a noninverted input terminal of the operational amplifier OPAMP via the switching circuit SWC. Further, the signal electrode output node is connected with an output of an inverter circuit for inverting the polarity inverting signal POL via the switching circuit SWB. Further, the signal electrode output node is connected with a signal line of the most significant bit of gray scale data selected in accordance with a polarity of a drive period specified by the polarity inverting signal POL via the switching circuit SWA.

On/off state of the switching circuit SWA is controlled by a switching control signal ca. On/off state of the switching circuit SWB is controlled by a switching control signal cb. On/off state of the switching circuit SWC is controlled to by a switching control signal cc. On/off state of the switching circuit SWD is controlled by a switching control signal cd.

The voltage follower circuit 56 drives the signal electrode by using the operational amplifier OPAMP based on the selected voltage Vs in the normal drive mode. Further, the voltage follower circuit 56 drives the signal electrode by using the polarity inverting signal POL or displays 8 colors by using the most significant bit of the gray scale data.

Figures 12A, 12B:
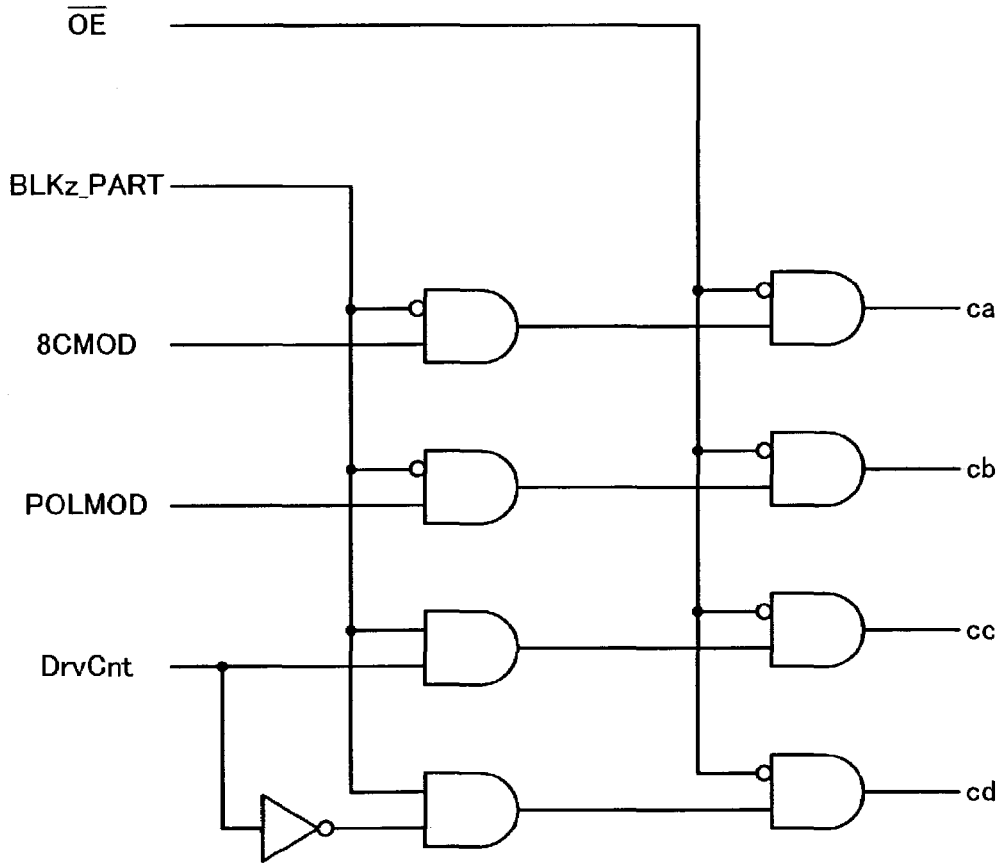
FIG. 12A shows a switching state of a switching circuit in each mode and FIG. 12B is a circuit diagram showing an example of a circuit of generating a switching control signal.

FIG. 12A shows switching states in the switching circuits SWA to SWD in the above-described modes. FIG. 12B shows an example of a circuit of generating the switching control signals ca to cb.

In the normal drive mode, the signal electrode output node is driven by the operational amplifier OPAMP during an operational amplifier drive period and during a resistor output drive period, the selected voltage Vs outputted from DAC 52 is outputted as it is by bypassing the operational amplifier OPAMP. Therefore, while switching the switching circuits SWA and SWB off, during the operational amplifier drive period, the switching circuit SWD is switched on and the switching circuit SWC is switched off and during the resistor output period, the switching circuit SWD is switched off and the switching circuit SWC is switched on.

Figure 13:
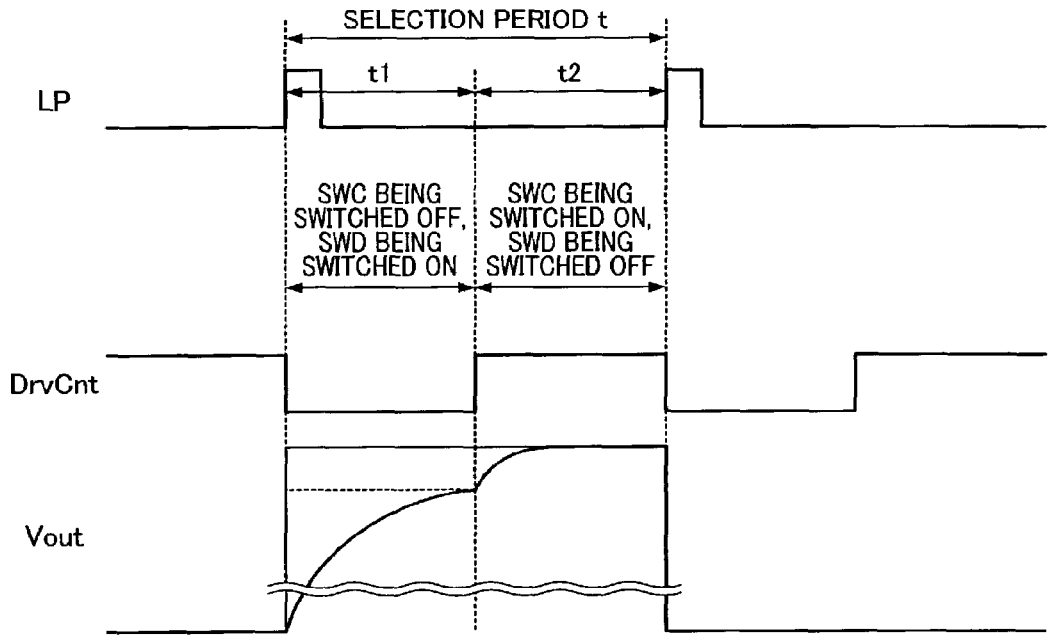
FIG. 13 is a timing chart showing an example of an operational timing of a normal drive mode in a voltage follower circuit.

FIG. 13 shows an example of an operational timing of the normal drive mode in the voltage follower circuit 56.

The switching circuits SWC and SWD are controlled by a control signal DrvCnt. According to the control signal DrvCnt generated by a control signal generating circuit, not illustrated, a logical level thereof is changed by a former half period (initial given period of drive period) t1 and a latter half period t2 of a selection period (drive period) t specified by the latch pulse signal LP. When the logical level of the control signal DrvCnt becomes "L" in the former half period t1, the switching circuit SWD is switched on and the switching circuit SWC is switched off. Further, when the logical level of the control signal DrvCnt becomes "H" in the later half period t2, the switching circuit SWD is switched off and the switching circuit SWC is switched on. Therefore, in the selection period t, at the former half period t1, the signal electrode is driven by converting impedance by the operational amplifier OPAMP connected by voltage follower connection and at the latter half period t2, the signal electrode is driven by using the selected voltage Vs outputted from DAC 52.

By driving the signal electrode in this way, at the former half period t1 necessary for charging liquid crystal capacitance, wiring capacitance and the like, the drive voltage Vout is elevated at high speed by the operational amplifier OPAMP connected by voltage follower connection having high drive capability and at the latter half period t2 in which high drive capability is not needed, the drive voltage can be outputted by DAC 52. Therefore, low power consumption can be achieved by minimizing a period of operating the operational amplifier OPAMP having significant consumption of current and a situation in which the selection period t is shortened and a charging period becomes deficient by an increase in a number of lines can be avoided.

In the partial mode shown in FIG. 12A, at a partial non-display area, 8 color display or POL drive is carried out. In 8 color display, by only using the most significant bit of the gray scale data, the corresponding signal electrode is driven. Therefore, while switching the switching circuits SWC and SWD off, the switching circuit SWA is switched on and the switching circuit SWB is switched off.

Therefore, when one pixel is assumed to comprise R, G and B signals, one pixel displays gray scale levels of $2^3$. That is, there can be carried out image display in which while in a partial display area, a desired moving image or still image is displayed, there are constituted a variety of display colors of a partial non-display area which is set as a background thereof.

Furthermore, in POL drive of the partial drive mode shown in FIG. 12A, by applying voltage in correspondence with the polarity by using the polarity inverting signal POL, black display or white display can be carried out. For that purpose, while switching the switching circuits SWC and SWD off, the switching circuit SWB is switched on and the switching circuit SWA is switched off.

In that case, while a desired moving image or a still image is displayed in the partial display area, black display or white display is carried out for the background color to thereby realize display of an image which is easy to see. At the same time, a DC component is not applied to liquid crystals at the non-display portion and deterioration of liquid crystals can be prevented.

Various control signals for controlling the voltage follower circuit 56 can be generated by a circuit shown by FIG. 12B. When a logical level of a 8 color display mode signal 8CMOD is "H", it shows that the mode is 8 color display of the partial drive mode. Whether 8 color display is carried out is set by, for example, a host, not illustrated. When a logical level of a POL drive mode signal POLMOD is "H", it shows that the mode is POL drive of the partial drive mode. Whether POL drive is carried out is set by, for example, a host, not illustrated.

In this way, the switching control signals ca to cd can be generated by using the various signals of 8CMOD, POLMOD and DrvCnt. Further, the switching control signals are masked by a partial block selection data BLKz_PART in correspondence with a block Bz such that 8 color display or POL drive is carried out only when a display line in correspondence with a signal electrode driven by the voltage follower circuit 56 belongs to the block set to a non-display state and normal drive is carried out when the display line belongs to the block set to a display state.

Further, according to the voltage follower circuit 56, the output can be brought into a high impedance state by the output enable signal XOE. Therefore, the various control signals are masked by the output enable signal XOE. That is, when the logical level of the output enable signal XOE is "H", the switching control signals ca to cd control the off state of the switching circuits of respective control objects.

Further, although according to the third constitution example, the first to fourth switching circuits are provided between the first and second ladder resistor circuits 212 and 222 and the first and second power source lines, there can be constructed a constitution of omitting these. In this case, it is not necessary to alternately switch the first and second power source voltages by driving to invert the polarity and therefore, it is not necessary to ensure a charge time period of each of the division nodes and current can be reduced by increasing a resistance value of the ladder resistor circuit.

3.4 Fourth Constitution Example

A reference voltage generation circuit according to a fourth constitution example includes ladder resistor circuits respectively for a positive polarity and a negative polarity and having high resistance and low resistance as total resistance thereof.

Figure 14:
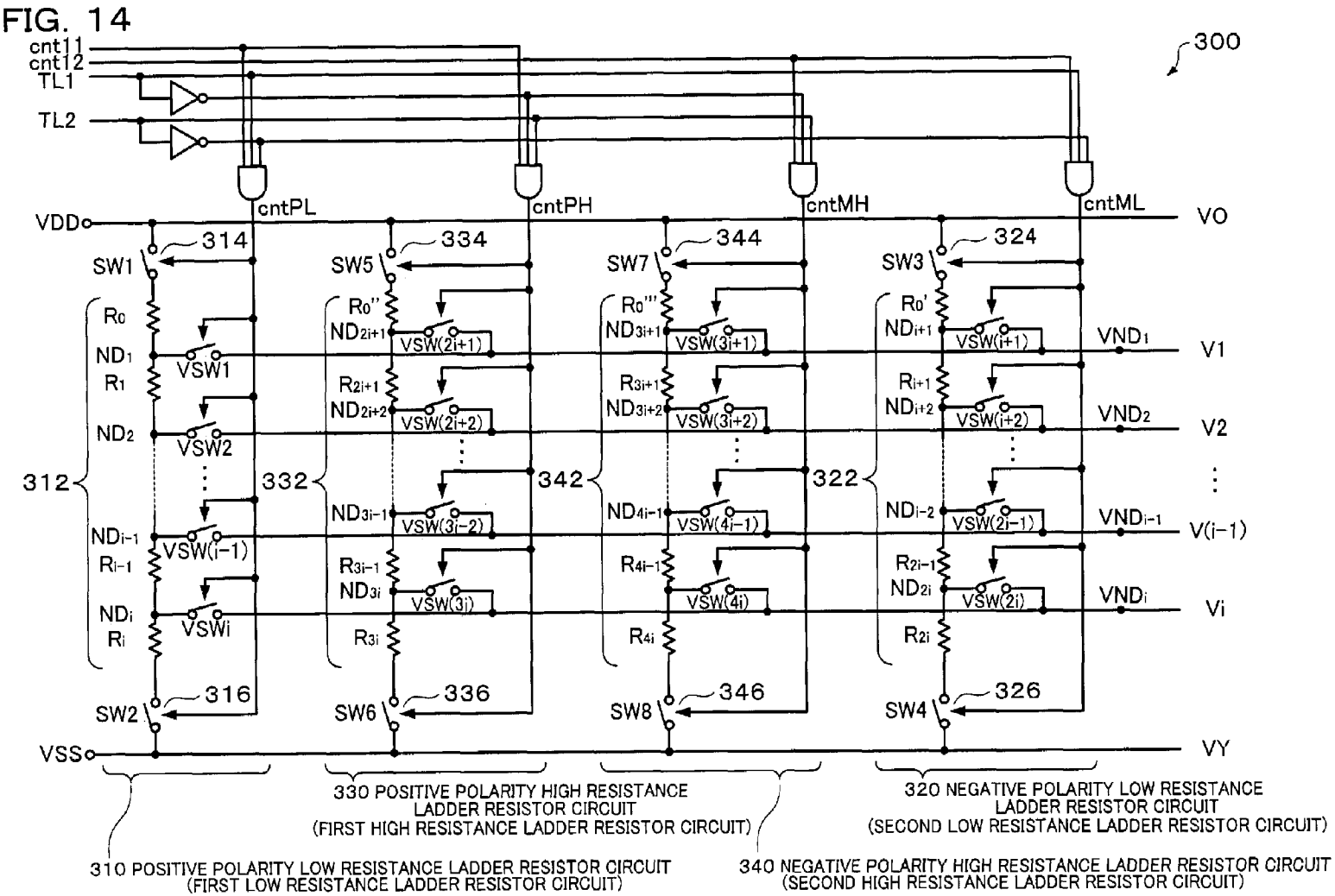
FIG. 14 is a constitutional diagram schematically showing a constitution of a reference voltage generation circuit according to a fourth constitution example.

FIG. 14 shows an outline of a constitution of a reference voltage generation circuit 300 according to the fourth constitution example.

That is, the reference voltage generation circuit 300 includes a low resistance ladder resistor circuit for a positive polarity (in a broad sense, first low resistance ladder resistor circuit) 310 used when total resistance is, for example, 20 kΩ and voltage applied to a liquid crystal is of a positive polarity and a low resistance ladder resistor circuit for a negative polarity (in a broad sense, second low resistance ladder resistor circuit) 320 used when total resistance is, for example, 20 kΩ similarly and voltage applied to a liquid crystal is of a negative polarity. Further, the reference voltage generation circuit 300 includes a high resistance ladder resistor circuit for a positive polarity (in a broad sense, first high resistance ladder resistor circuit) 330 used when total resistance is, for example, 90 kΩ and voltage applied to a liquid crystal is of a positive polarity and a high resistance ladder resistor circuit for a negative polarity (in a broad sense, second high resistance ladder resistor circuit) 340 used when total resistance is, for example, 90 kΩ similarly and voltage applied to a liquid crystal is of a negative polarity.

The positive polarity low resistance ladder resistor circuit 310 and the positive polarity high resistance ladder resistor circuit 330 are constructed by a constitution similar to that of the positive polarity ladder resistor circuit 210 shown in FIG. 10. The negative polarity low resistance ladder resistor circuit 320 and the negative polarity high resistance ladder resistor circuit 340 are constructed by a constitution similar to that of the negative polarity ladder resistor circuit 220 shown in FIG. 10. However, on/off state of each of the switching circuits are controlled by using the switching control signals cnt11 and cnt12 and timer count signals (in a broad sense, control period designating signals) TL1 and TL2. Further, regardless of a polarity of voltage applied to a liquid crystal, power source voltages on a high potential side and a low potential side (first and second power source voltages) are fixed.

The positive polarity low resistance ladder resistor circuit 310 includes a first ladder resistor circuit 312 having resistor circuits with total resistance of, for example, 20 kΩ and connected in series by resistance ratios for a positive polarity. One end of the first ladder resistor circuit 312 is connected to the first power source line supplied with the first power source voltage via a first switching circuit (SW1) 314. Other end of the first ladder resistor circuit 322 is connected to the second power source line supplied with the second power source voltage via a second switching circuit (SW2) 316.

The first to i-th reference voltage output switching circuits VSW1 to VSWi are inserted between first to i-th division nodes $ND_1$ to $ND_i$ which are formed by dividing the ladder resistor circuit by the resistor circuits $R_0$ to $R_i$ constituting the first ladder resistor circuit 312 and first to i-th reference voltage output nodes $VND_1$ to $VND_i$.

On/off state of the first and second switching circuits SW1 and SW2 and first to i-th reference voltage output switching circuits VSW1 to VSWi are controlled by a switching control signal cntPL (in a broad sense, first switching control signal). The switching control signal cntPL is generated by using the switching control signal cnt11 generated as shown in FIG. 10 and the timer count signals TL1 and TL2. That is, when a logical level of the timer count signal TL1 is "H" and a logical level of the timer count signal TL2 is "L", on/off state of the circuits are controlled in accordance with the switching control signal cnt11.

The negative polarity low resistance ladder resistor circuit 320 includes a second ladder resistor circuit 322 having resistor circuits with total resistance of, for example, 20 kΩ and connected in series by resistance ratios for a negative polarity. One end of the second ladder resistor circuit 322 is connected to the first power source line supplied with the first power source voltage via a third switching circuit (SW3) 324. Other end of the second ladder resistor circuit 322 is connected to the second power source line supplied with the second power source voltage via a fourth switching circuit (SW4) 326.

The (i+1)th to 2i-th reference voltage output switching circuits VSW(i+1) to VSW2i are inserted between (i+1)th to 2i-th division nodes $ND_{i+1}$ to $ND_{2i}$ which are formed by dividing the ladder resistor circuit by the resistor circuits $R_0'$ and $R_{i+1}$ to $R_{2i}$ constituting the second ladder resistor circuit 322 and first to i-th reference voltage output nodes $VND_1$ to $VND_i$.

On/off state of the third and the fourth switching circuits SW3 and SW4 and (i+1)th to 2i-th reference voltage output switching circuits VSW(i+1) to VSW2i are controlled by a switching control signal cntML (in a broad sense, second switching control signal). The switching control signal cntML is generated by using the switching control signal cnt12 generated as shown in FIG. 10 and the timer count signals TL1 and TL2. That is, when the logical level of the timer count signal TL1 is "H" and the logical level of the timer count signal TL2 is "L", on/off states of the circuit are controlled in accordance with the switching control signal cnt11.

The positive polarity high resistance ladder resistor circuit 330 includes a third ladder resistor circuit 332 having resistor circuits with total resistance of, for example, 90 kΩ and connected in series by resistance ratios for a positive polarity. One end of the third ladder resistor circuit 332 is connected to the first power source line supplied with the first power source voltage via a fifth switching circuit (SW5) 334. Other end of the third ladder resistor circuit 332 is connected to the second power source line supplied with the second power source voltage via a sixth switching circuit (SW6) 336.

The (2i+1)th to 3i-th reference voltage output switching circuits VSW(2i+1) to VSW3i are inserted between (2i+1)th to 3i-th division nodes $ND_{2i+1}$ to $ND_{3i}$ which are formed by dividing the ladder resistor circuit by the resistor circuits $R_0''$ and $R_{2i+1}$ to $R_{3i}$ constituting the third ladder resistor circuit 332 and first to i-th reference voltage output nodes $VND_1$ to $VND_i$.

On/off state of the fifth and the sixth switching circuits SW5 and SW6 and (2i+1)th to 3i-th reference voltage output switching circuits VSW(2i+1) to VSW3i are controlled by a switching control signal cntPH (in a broad sense, third switching control signal). The switching control signal cntPH is generated by using the switching control signal cnt11 generated as shown in FIG. 10 and the timer count signals TL1 and TL2. That is, when the logical level of the timer count signal TL1 is "L" and the logical level of the timer count signal TL2 is "H", on/off states of the circuits are controlled in accordance with the switching control signal cnt11.

The negative polarity high resistance ladder resistor circuit 340 includes a fourth ladder resistor circuit 342 having resistor circuits with total resistance of, for example, 90 kΩ and connected in series by resistance ratios for a negative polarity. One end of the fourth ladder resistor circuit 342 is connected to the first power source line supplied with the first power source voltage via a seventh switching circuit (SW7) 344. Other end of the fourth ladder resistor circuit 342 is connected to the second power source line supplied with the second power source voltage via an eighth switching circuit (SW8) 346.

The (3i+1)th to 4i-th reference voltage output switching circuits VSW(3i+1) to VSW4i are inserted between (3i+1)th to 4i-th division nodes $ND_{3i+1}$ to $ND_{4i}$ which are formed by dividing the ladder resistor circuit by the resistor circuits R0''' and $R_{3i+1}$ to $R_{4i}$ constituting the fourth ladder resistor circuit 342 and first to i-th reference voltage output nodes $VND_1$ to $VND_i$.

On/off state of the seventh and the eighth switching circuits SW7 and SW8 and (3i+1)th to 4i-th reference voltage output switching circuits VSW(3i+1) to VSW4i are controlled by a switching control signal cntPH (in a broad sense, fourth switching control signal). The switching control signal cntPH is generated by using the switching control signal cnt12 generated as shown in FIG. 10 and the timer count signals TL1 and TL2. That is, when the logical level of the timer count signal TL1 is "L" and the logical level of the timer count signal TL2 is "H", on/off states of the circuits are controlled in accordance with the switching control signal cnt12.

Figure 15:
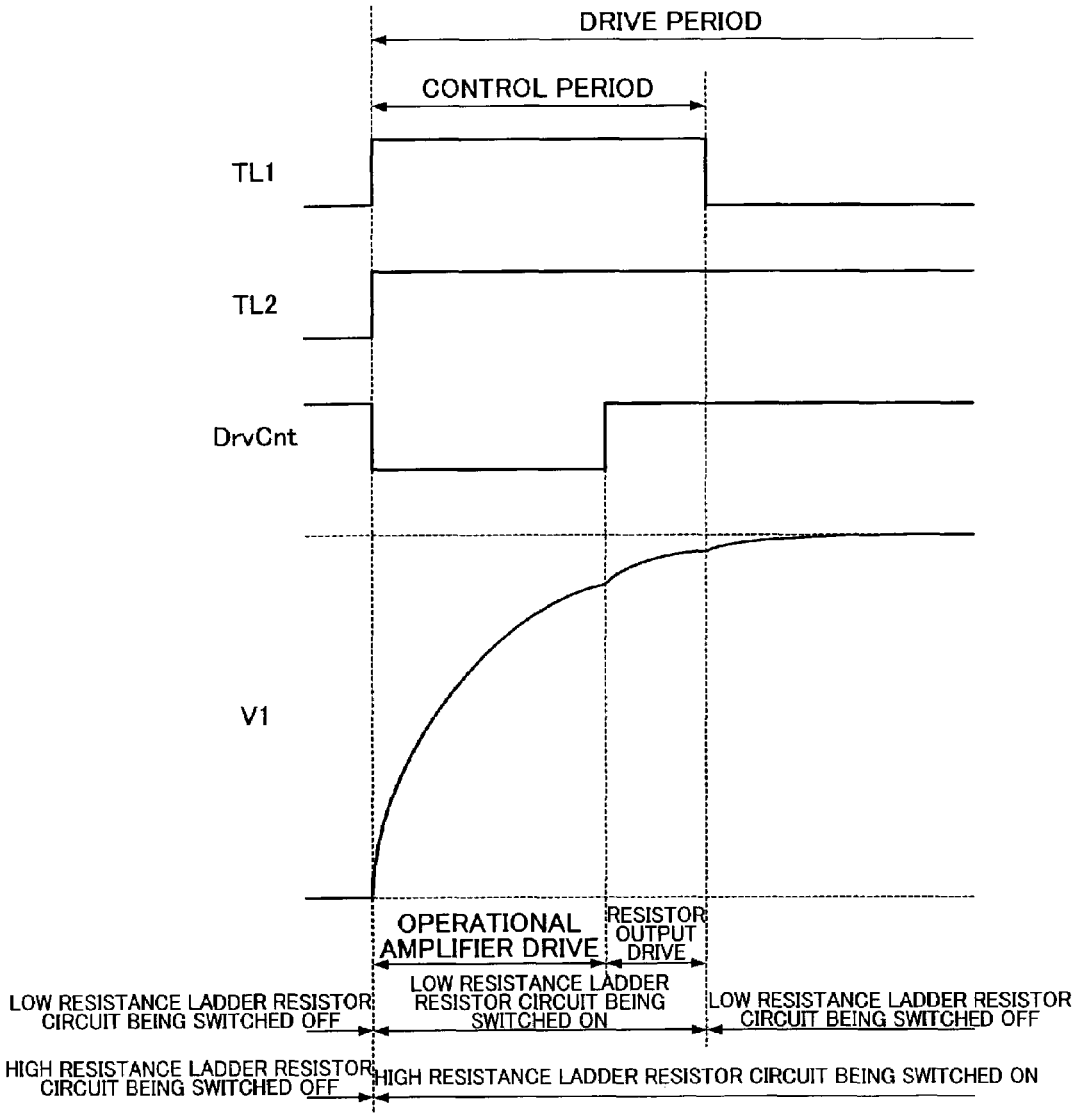
FIG. 15 is a timing chart showing an example of a control timing of the reference voltage generation circuit according to the fourth constitution example.

FIG. 15 shows an example of a control timing of the reference voltage generation circuit 300 shown in FIG. 14.

Shown here is a control timing when polarity inversion drive is carried out by a positive polarity with respect to the first reference voltage V1.

The signal driver IC including the reference voltage generation circuit 300 starts driving with a fall edge of the latch pulse signal LP specifying a horizontal scan period timing as a reference. Further, in the drive period, according to the reference voltage generation circuit 300, the positive high resistance ladder resistor circuit 330 and the negative polarity high resistance ladder resistor 340 are used. Further, at an initial control period of the drive period, at the same time, the positive polarity low resistance ladder resistor circuit 310 and the negative polarity low resistance ladder resistor circuit 320 are also used. That is, in the control period, the positive polarity high resistance ladder resistor circuit 330, the negative polarity high resistance ladder resistor circuit 340, the positive polarity low resistance ladder resistor circuit 310 and the negative polarity low resistance ladder resistor circuit 320 are used.

In this way, current flows to the ladder resistor circuit having low resistance in the control period and therefore, it is not necessary to control the high resistance ladder resistor circuit.

Further, the control period is specified by the control signal DrvCnt as shown by FIG. 15. That is, after driving the operational amplifier by the voltage follower circuit 56 as shown by FIG. 13, resistor output drive is carried out.

In this way, according to the fourth constitution example, after driving the operational amplifier by using the low resistance ladder resistor circuit, resistor output drive is carried out and thereafter, the reference voltage V1 is generated by the high resistance ladder resistor circuit. Thereby, although there is a case in which a charge time period sufficient for elevating the division node to the first reference voltage V1 cannot be ensured when resistor output drive is carried out by the high resistance ladder resistor circuit after driving the operational amplifier, the charge time period can be ensured by carrying out resistor output drive by the low resistance ladder resistor circuit after driving the operational amplifier. Further, by generating the reference voltage by using the high resistance ladder resistor circuit thereafter, current flowing to the ladder resistor circuit can be reduced and low power consumption can be achieved.

Further, although according to the third constitution example, the first to eighth switching circuits SW1 to SW8 are provided between the first to fourth ladder resistor circuits 312, 322, 332 and 342 and the first and second power source lines, there can be constructed a constitution of omitting these. In this case, it is not necessary to alternately switch the first and second power source voltages by polarity inversion drive and therefore, it is not necessary to ensure the charge time period of each of the division nodes and the resistance value of the ladder resistor circuit can be increased and the current can be reduced.

4. Others

Although in the above-described, a description has been given by taking an example of the liquid crystal device having the liquid crystal panel using TFT, the invention is not limited thereto. The reference voltage generated by the reference voltage generation circuit 50 may be converted to current by a given current conversion circuit to supply to an element of a current drive type. Thereby, the invention is applicable to, for example, a signal driver IC for driving to display an organic EL panel including an organic EL element provided in correspondence with a pixel specified by a signal electrode and a scan electrode. Particularly, when polarity inversion drive is not carried out in an organic EL panel, the difference voltage generation circuits according to the first and second constitution examples can be used.

Figure 16:
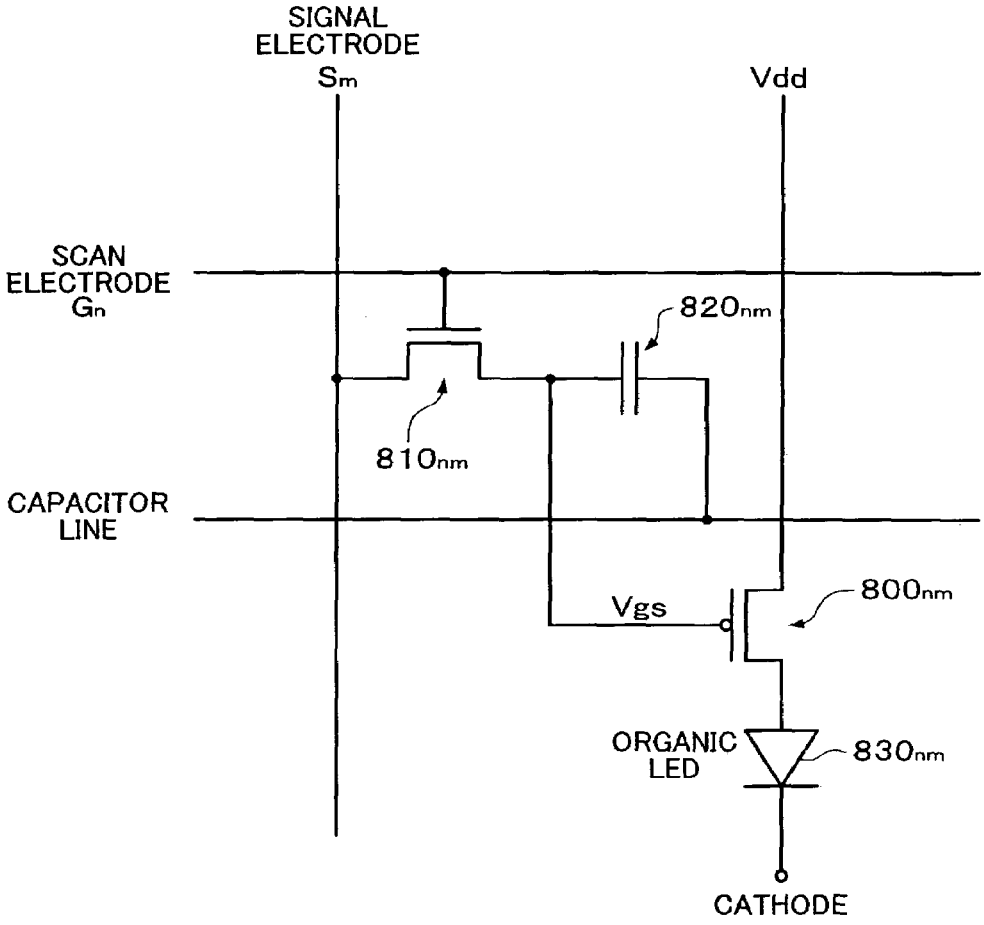
FIG. 16 is a constitutional diagram showing an example of a pixel circuit of a 2 transistor system in an organic EL panel.

FIG. 16 shows an example of a pixel circuit of a two transistor system in an organic EL panel driven by such a signal driver IC.

The organic EL panel includes a drive TFT $\mathbf{800}_{nm}$, a switching TFT $\mathbf{810}_{nm}$, a hold capacitor TFT $\mathbf{820}_{nm}$ and an organic LED $\mathbf{830}_{nm}$ at an intersection of a signal electrode $S_m$ and a scan electrode $G_n$. The drive TFT $\mathbf{800}_{nm}$ is constituted by a p-type transistor.

The drive TFT $\mathbf{800}_{nm}$ and the organic LED $\mathbf{830}_{nm}$ are connected in series with a power source line.

The switching TFT $\mathbf{810}_{nm}$ is inserted between a gate electrode of the drive LED $\mathbf{800}_{nm}$ and the signal electrode $S_m$. The gate electrode of the switching TFT $\mathbf{810}_{nm}$ is connected to the scan electrode $G_n$.

The hold capacitor $\mathbf{820}_{nm}$, is inserted between the gate electrode of the drive TFT $\mathbf{800}_{nm}$, and a capacitor line.

In the organic EL element, when the scan electrode $G_n$ is driven and the switching TFT $\mathbf{810}_{nm}$ is switched on, voltage of the signal electrode $S_m$ is written to the hold capacitor $\mathbf{820}_{nm}$ and applied to the gate electrode of the drive TFT $\mathbf{800}_{nm}$. Gate voltage Vgs is determined by voltage of the signal electrode $S_m$ and current flowing to the drive TFT $\mathbf{800}_{nm}$ is determined. Since the drive TFT $\mathbf{800}_{nm}$ and the organic LED $\mathbf{830}_{nm}$ are connected in series, current flowing to the drive TFT $\mathbf{800}_{nm}$ becomes current flowing to the organic LED $\mathbf{830}_{nm}$ as it is.

Therefore, by holding the gate voltage Vgs in accordance with the voltage of the signal electrode $S_m$ by the hold capacitor $\mathbf{820}_{nm}$, for example, during one frame period, by flowing current in correspondence with the gate voltage Vgs to the organic LED $\mathbf{830}_{nm}$, a pixel which continues lighting during the frame can be realized.

Figure 17A:
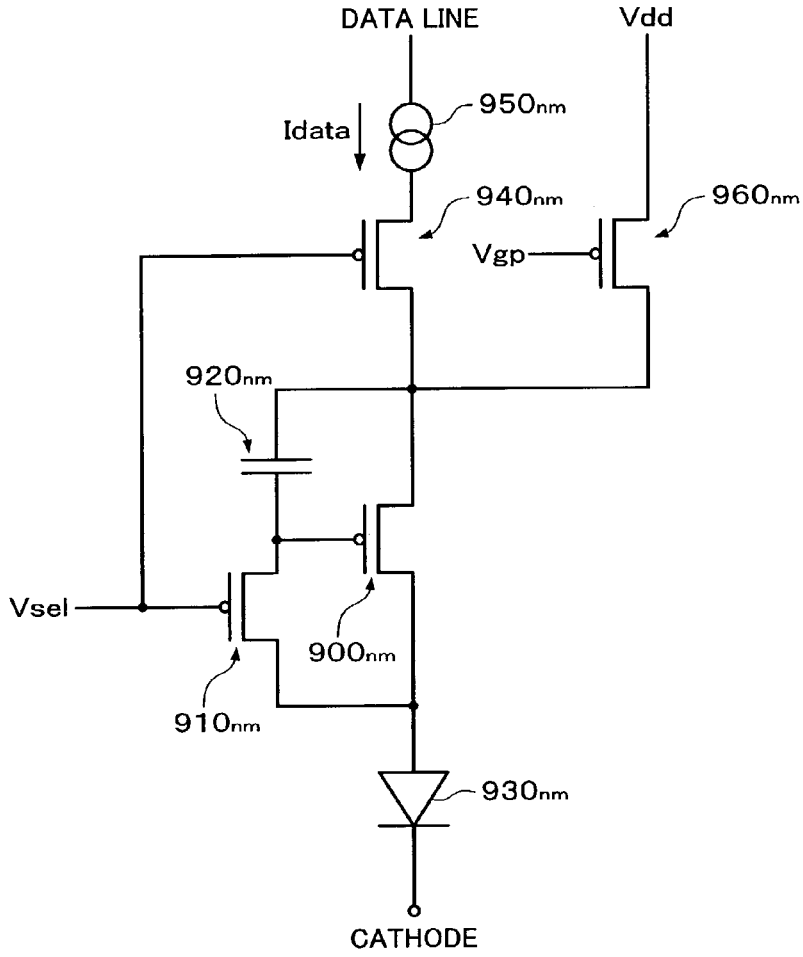
FIG. 17A is a circuit constitutional diagram showing an example of a pixel circuit of a 4 transistor system in an organic EL panel and FIG. 17B is a timing chart showing an example of a display control timing of the pixel circuit.
Figure 17B:
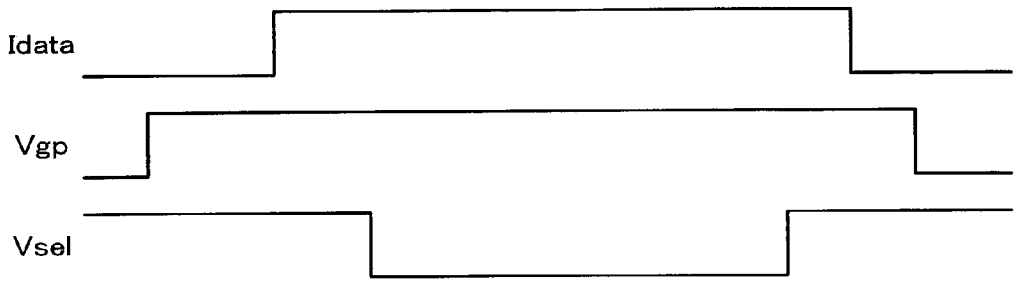

FIG. 17A shows an example of a pixel circuit of a four transistor system in an organic EL panel driven by using a signal driver IC. FIG. 17B shows an example of a display control timing of the pixel circuit.

Also in this case, the organic EL panel includes a drive TFT $\mathbf{900}_{nm}$, a switching TFT $\mathbf{910}_{nm}$, a hold capacitor $\mathbf{920}_{nm}$ and an organic LED $\mathbf{930}_{nm}$.

A point which differs from the pixel circuit of the two transistor systems shown in FIG. 16, resides in that in place of constant voltage, constant current Idata from a constant current source $\mathbf{950}_{nm}$ is supplied to the pixel via a p-type TFT $\mathbf{940}_{nm}$ as a switching element and that the hold capacitor $\mathbf{920}_{nm}$ and the drive TFT $\mathbf{900}_{nm}$ are connected to the power source line via a p-type TFT $\mathbf{960}_{nm}$ as a switching element.

In the organic EL element, first, the p-type TFT $\mathbf{960}_{nm}$ is turned off by gate voltage Vgp to thereby cut the power source line, the p-type TFT $\mathbf{940}_{nm}$ and the switching TFT $\mathbf{910}_{nm}$ are switched on by gate voltage Vsel and the constant current Idata from the constant current source $\mathbf{950}_{nm}$ is made to flow to the drive TFT $\mathbf{900}_{nm}$.

During a period until current flowing to the drive TFT $\mathbf{900}_{nm}$ is stabilized, voltage in accordance with the constant current Idata is held at the hold capacitor $\mathbf{920}_{nm}$.

Successively, the p-type TFT $\mathbf{940}_{nm}$ and the switching TFT $\mathbf{910}_{nm}$ are turned off by the gate voltage Vsel, further, the p-type TFT $\mathbf{960}_{nm}$ is switched on by the gate voltage Vgp and the power source line, the drive TFT $\mathbf{900}_{nm}$, and the organic LED $\mathbf{930}_{nm}$ are electrically connected. At this occasion, by voltage held at the hold capacitor $\mathbf{920}_{nm}$, current having a magnitude substantially equivalent to the constant current Idata or in accordance therewith is supplied to the organic LED $\mathbf{930}_{nm}$.

In such an organic EL element, the scan electrode can be constituted as an electrode applied with the gate voltage Vsel and the signal electrode can be constituted as a data line.

The organic LED may be provided with a light emitting layer above a transparent anode (ITO) and provided with a metal cathode further thereabove, a light emitting layer, a light transmitting cathode and a transparent seal may be provided above a metal anode and the organic LED is not limited to an element structure thereof.

By constituting the signal driver IC for driving to display the organic EL panel including the organic EL element described above as described above, the signal driver IC generally used in the organic EL panel can be provided.

Further, the invention is not limited to the above-described embodiments but various modifications can be carried out within a range of the gist of the invention. For example, the invention is applicable also to a plasma display device.

Further, the invention is not limited to the constitutions of the resistor circuit and the switching circuit in the above-described embodiments. The resistor circuit can be constituted by connecting a single or a plurality of resistor elements in series or in parallel. Or, the resistor value can be constituted to be variable by connecting resistor elements and a single or a plurality of switching circuits in series or in parallel. Further, the switching circuit can be constituted by, for example, MOS transistors.

What is claimed is:

1. A reference voltage generation circuit which generates multi-valued reference voltages for generating a gray scale value corrected by gamma correction based on gray scale data, the reference voltage generation circuit comprising:

a ladder resistor circuit including a plurality of resistor circuits connected in series, and outputting voltages of first to i-th division nodes ("i" is an integer larger than or equal to 2) as first to i-th reference voltages, the first to i-th division nodes being formed by dividing the ladder resistor circuit by the resistor circuits;

a first switching circuit inserted between a first power source line supplied with a first power source voltage and one end of the ladder resistor circuit; and a second switching circuit inserted between a second power source line supplied with a second power source voltage and the other end of the ladder resistor circuit, wherein on/off state of the first and second switching circuits are controlled based on first and second switching control signals, and wherein the first and second switching control signals are generated based on an output enable signal and a latch pulse signal when all signal electrodes of a display panel are driven, the output enable signal controlling drive of a signal electrode, and the latch pulse signal indicating a timing of scan period.

2. The reference voltage generation circuit as defined by claim 1, further comprising:

first to i-th reference voltage output switching circuits respectively inserted between the first to i-th division nodes and first to i-th reference voltage output nodes for outputting the first to i-th reference voltages, wherein on/off state of the first to i-th reference voltages output switching circuits are controlled based on one of the first and second switching control signals.

3. A display drive circuit comprising:

the reference voltage generation circuit as defined by claim 2;

a voltage selection circuit which selects a voltage based on gray scale data, from the multi-valued reference voltages generated by the reference voltage generation circuit; and a signal electrode drive circuit which drives a signal electrode by using the voltage selected by the voltage selection circuit.

4. The reference voltage generation circuit as defined by claim 1, wherein the first and second switching circuits are switched on by the first and second switching control signals during a given driving period based on the first to i-th reference voltages, and wherein the first and second switching circuits are switched off during a period when a signal electrode of a display panel is not driven based on the first to i-th reference voltages.

5. A display drive circuit comprising:

the reference voltage generation circuit as defined by claim 4;

a voltage selection circuit which selects a voltage based on gray scale data, from the multi-valued reference voltages generated by the reference voltage generation circuit; and a signal electrode drive circuit which drives a signal electrode by using the voltage selected by the voltage selection circuit.

6. The reference voltage generation circuit as defined by claim 1, wherein the first and second switching circuits are switched off by the first and second switching control signals, when all blocks are set to a non-display state by partial block selection data for setting display lines of a display panel to a display state or the non-display state for each of the blocks formed of a plurality of signal electrodes, each of the display lines corresponding with each of the signal electrodes in each of the blocks.

7. A display drive circuit comprising:

the reference voltage generation circuit as defined by claim 1;

a voltage selection circuit which selects a voltage based on gray scale data, from the multi-valued reference voltages generated by the reference voltage generation circuit; and a signal electrode drive circuit which drives a signal electrode by using the voltage selected by the voltage selection circuit.

8. A display device comprising:

a plurality of signal electrodes;

a plurality of scan electrodes intersecting with the signal electrodes;

a pixel specified by one of the signal electrodes and one of the scan electrodes;

the display drive circuit as defined by claim 7 which drives the signal electrodes; and a scan electrode drive circuit which drives the scan electrodes.

9. A display device comprising:

a display panel including:

a plurality of signal electrodes, a plurality of scan electrodes intersecting with the signal electrodes, and a pixel specified by one of the signal electrodes and one of the scan electrodes;

the display drive circuit as defined by claim 7 which drives the signal electrodes; and a scan electrode drive circuit which drives the scan electrodes.

10. A reference voltage generation circuit which generates multi-valued reference voltages for generating a gray scale value corrected by gamma correction based on gray scale data, the reference voltage generation circuit comprising:

a ladder resistor circuit including a plurality of resistor circuits connected in series, and outputting voltages of first to i-th division nodes ("i" is an integer larger than or equal to 2) as first to i-th reference voltages, the first to i-th division nodes being formed by dividing the ladder resistor circuit by the resistor circuits;

a first switching circuit inserted between a first power source line supplied with a first power source voltage and one end of the ladder resistor circuit; and a second switching circuit inserted between a second power source line supplied with a second power source voltage and the other end of the ladder resistor circuit, wherein on/off state of the first and second switching circuits are controlled based on first and second switching control signals, and wherein the first and second switching circuits are switched off by the first and second switching control signals, when all blocks are set to a non-display state by partial block selection data for setting display lines of a display panel to a display state or the non-display state for each of the blocks formed of a plurality of signal electrodes, each of the display lines corresponding with each of the signal electrodes in each of the blocks, and wherein the first and second switching control signals are generated based on an output enable signal and a latch pulse signal when all signal electrodes of a display panel are driven, the output enable signal controlling drive of a signal electrodes, and the latch pulse signal indicating a timing of scan period.

11. A display drive circuit comprising:

the reference voltage generation circuit as defined by claim 10;

a voltage selection circuit which selects a voltage based on gray scale data, from the multi-valued reference voltages generated by the reference voltage generation circuit; and a signal electrode drive circuit which drives a signal electrode by using the voltage selected by the voltage selection circuit.

12. A display drive circuit comprising:

a partial block selection register which holds partial block selection data for setting display lines of a display panel to a display state or a non-display state for each of blocks formed of a plurality of signal electrodes, each of the display lines corresponding with each of the signal electrodes in each of the blocks;

the reference voltage generation circuit as defined by claim 5 which generates a reference voltage for driving the signal electrodes for each of the blocks based on the partial block selection data;

a voltage selection circuit which selects a voltage based on gray scale data, from the multi-valued reference voltages generated by the reference voltage generation circuit; and a signal electrode drive circuit which drives a signal electrode by using the voltage selected by the voltage selection circuit.

13. A reference voltage generation circuit which generates multi-valued reference voltages for generating a gray scale value corrected by gamma correction based on gray scale data, the reference voltage generation circuit comprising:

a ladder resistor circuit including a plurality of resistor circuits connected in series, and outputting voltages of first to i-th division nodes ("i" is an integer larger than or equal to 2) as first to i-th reference voltages, the first to i-th division nodes being formed by dividing the ladder resistor circuit by the resistor circuits;

a first switching circuit inserted between a first power source line supplied with a first power source voltage and one end of the ladder resistor circuit;

a second switching circuit inserted between a second power source line supplied with a second power source voltage and the other end of the ladder resistor circuit; and first to i-th reference voltage output switching circuits respectively inserted between the first to i-th division nodes and first to i-th reference voltage output nodes for outputting the first to i-th reference voltages, wherein on/off state of the first to i-th reference voltages output switching circuits are controlled based on one of the first and second switching control signals, wherein on/off state of the first and second switching circuits are controlled based on first and second switching control signals, and wherein the first and second switching circuits are switched off by the first and second switching control signals, when all blocks are set to a non-display state by partial block selection data for setting display lines of a display panel to a display state or the non-display state for each of the blocks formed of a plurality of signal electrodes, each of the display lines corresponding with each of the signal electrodes in each of the blocks, and wherein the first and second switching control signals are generated based on an output enable signal and a latch pulse signal when all signal electrodes of a display panel are driven, the output enable signal controlling drive of a signal electrodes, and the latch pulse signal indicating a timing of scan period.

14. A reference voltage generation circuit which generates multi-valued reference voltages for generating a gray scale value corrected by gamma correction based on gray scale data, the reference voltage generation circuit comprising:

a ladder resistor circuit including a plurality of resistor circuits connected in series, and outputting voltages of first to i-th division nodes ("i" is an integer larger than or equal to 2) as first to i-th reference voltages, the first to i-th division nodes being formed by dividing the ladder resistor circuit by the resistor circuits;

a first switching circuit inserted between a first power source line supplied with a first power source voltage and one end of the ladder resistor circuit; and a second switching circuit inserted between a second power source line supplied with a second power source voltage and the other end of the ladder resistor circuit, wherein on/off state of the first and second switching circuits are controlled based on first and second switching control signals, wherein the first and second switching circuits are switched on by the first and second switching control signals during a given driving period based on the first to i-th reference voltages, wherein the first and second switching circuits are switched off during a period when a signal electrode of a display panel is not driven based on the first to i-th reference voltages, and wherein the first and second switching circuits are switched off by the first and second switching control signals, when all blocks are set to a non-display state by partial block selection data for setting display lines of a display panel to a display state or the non-display state for each of the blocks formed of a plurality of signal electrodes, each of the display lines corresponding with each of the signal electrodes in each of the blocks, and wherein the first and second switching control signals are generated based on an output enable signal and a latch pulse signal when all signal electrodes of a display panel are driven, the output enable signal controlling drive of a signal electrodes and the latch pulse signal indicating a timing of scan period.

15. A reference voltage generation method for generating multi-valued reference voltages for generating a gray scale value corrected by gamma correction based on gray scale data, the method comprising:

electrically connecting two opposed ends of a ladder resistor circuit with first and second power source lines, respectively, the ladder resistor circuit outputting voltages of first to i-th division nodes ("i" is an integer larger than or equal to 2) as first to i-th reference voltages, the first to i-th division nodes being formed by dividing the ladder resistor circuit by a plurality of resistor circuits connected in series, the first and second power source lines being supplied with first and second power source voltages, respectively, during a given driving period based on the first to i-th reference voltages, and electrically disconnecting the two ends of the ladder resistor circuit from the first and second power source lines, during a period when a signal electrode of a display panel is not driven based on the first to i-th reference voltages, wherein the two ends of the ladder resistor circuit disconnects from the first and second power source lines, when all blocks are set to a non-display state by partial block selection data for setting display lines of a display panel to a display state or the non-display state for each of the blocks formed of a plurality of signal electrodes, each of the display lines corresponding with each of the signal electrodes in each of the blocks;

a first switching circuit inserted between the first power source line supplied with the first power source voltage and one end of the ladder resistor circuit; and a second switching circuit inserted between the second power source line supplied with the second power source voltage and the other end of the ladder resistor circuit, wherein on/off state of the first and second switching circuits are controlled based on first and second switching control signals, and wherein the first and second switching control signals are generated based on an output enable signal and a latch pulse signal when all signal electrodes of a display panel are driven, the output enable signal controlling drive of a signal electrode, and the latch pulse signal indicating a timing of scan period.

16. The reference voltage generation method as defined by claim 15, the method further comprising:

electrically connecting the first to i-th division nodes with first to i-th reference voltage output nodes that outputs the first to i-th reference voltages, during the driving period; and electrically disconnecting the first to i-th division nodes from the first to i-th reference voltage output nodes, during a period when a signal electrode of a display panel is not driven based on the first to i-th reference voltages.

* * * * *